US009727011B2

(12) United States Patent
Ikebuchi et al.

(10) Patent No.: US 9,727,011 B2
(45) Date of Patent: Aug. 8, 2017

(54) IMAGE FORMING APPARATUS AND IMAGE FORMING METHOD

(71) Applicants: Yutaka Ikebuchi, Kanagawa (JP); Hiroshi Yoshinaga, Chiba (JP); Takayuki Seki, Kanagawa (JP); Yuji Arai, Kanagawa (JP); Ryuuichi Mimbu, Kanagawa (JP); Shuntaro Tamaki, Kanagawa (JP); Kazuya Saito, Kanagawa (JP); Shuutaroh Yuasa, Kanagawa (JP); Toshihiko Shimokawa, Kanagawa (JP); Masaaki Yoshikawa, Tokyo (JP); Toshiharu Hachisuka, Kanagawa (JP)

(72) Inventors: Yutaka Ikebuchi, Kanagawa (JP); Hiroshi Yoshinaga, Chiba (JP); Takayuki Seki, Kanagawa (JP); Yuji Arai, Kanagawa (JP); Ryuuichi Mimbu, Kanagawa (JP); Shuntaro Tamaki, Kanagawa (JP); Kazuya Saito, Kanagawa (JP); Shuutaroh Yuasa, Kanagawa (JP); Toshihiko Shimokawa, Kanagawa (JP); Masaaki Yoshikawa, Tokyo (JP); Toshiharu Hachisuka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/216,863

(22) Filed: Jul. 22, 2016

(65) Prior Publication Data

US 2016/0327891 A1 Nov. 10, 2016

Related U.S. Application Data

(62) Division of application No. 14/564,291, filed on Dec. 9, 2014, now Pat. No. 9,448,514.

(30) Foreign Application Priority Data

Dec. 26, 2013 (JP) ..... 2013-269802

(51) Int. Cl.
*G03G 15/20* (2006.01)
*G03G 15/00* (2006.01)

(52) U.S. Cl.
CPC ..... *G03G 15/2039* (2013.01); *G03G 15/205* (2013.01); *G03G 15/2042* (2013.01);
(Continued)

(58) Field of Classification Search
CPC ..... G03G 15/2039; G03G 15/2042; G03G 15/2046; G03G 15/205; G03G 15/2078; G03G 15/2082
See application file for complete search history.

(56) References Cited

U.S. PATENT DOCUMENTS 5,041,718 A 8/1991 d'Hondt
6,243,558 B1 * 6/2001 Oota ..... G03G 15/2025 15/256.51

(Continued)

FOREIGN PATENT DOCUMENTS

JP 2001-305906 11/2001
JP 2002-268421 9/2002

(Continued)

*Primary Examiner* — David M Gray
*Assistant Examiner* — Carla Therrien
(74) *Attorney, Agent, or Firm* — Oblon, McClelland, Maier & Neustadt, L.L.P.

(57) ABSTRACT

An image forming apparatus includes a first heater disposed opposite and heating at least a center of a fixing belt in an axial direction thereof and a second heater disposed opposite and heating at least a lateral end of the fixing belt in the axial direction thereof. A power supply supplies power to the first heater and the second heater. A controller that controls the power supply includes a calculator to calculate an elapsed (Continued)

time elapsed after at least one of the first heater and the second heater starts heating the fixing belt. The controller controls the power supply to supply power to the first heater and the second heater such that a power density of the second heater is greater than a power density of the first heater when the elapsed time calculated by the calculator is smaller than a predetermined time.

7 Claims, 13 Drawing Sheets

(52) U.S. Cl.
CPC ..... *G03G 15/2082* (2013.01); *G03G 15/80* (2013.01); *G03G 2215/2035* (2013.01)

(56) References Cited

U.S. PATENT DOCUMENTS

| | | | | |
|---|---|---|---|---|
| 6,298,215 | B1 | 10/2001 | Nomura | |
| 6,539,185 | B2 | 3/2003 | Hanyu | |
| 6,996,363 | B2 | 2/2006 | Aoki | |
| 7,187,880 | B2 | 3/2007 | Senda | |
| 7,199,332 | B2 | 4/2007 | Kagawa | |
| 9,158,248 | B2 | 10/2015 | Arai et al. | |
| 9,164,443 | B2 | 10/2015 | Shimokawa et al. | |
| 2003/0059235 | A1 | 3/2003 | Senda | |
| 2003/0190170 | A1 | 10/2003 | Hamada | |
| 2003/0202814 | A1* | 10/2003 | Senda | G03G 15/2042 399/69 |
| 2005/0095043 | A1 | 5/2005 | Yoshinaga et al. | |
| 2007/0292175 | A1 | 12/2007 | Shinshi | |
| 2010/0067929 | A1 | 3/2010 | Seki | |
| 2010/0092221 | A1 | 4/2010 | Shinshi et al. | |
| 2011/0150518 | A1 | 6/2011 | Hase et al. | |
| 2011/0182634 | A1 | 7/2011 | Ishigaya et al. | |
| 2012/0051774 | A1 | 3/2012 | Ikebuchi et al. | |
| 2013/0071134 | A1 | 3/2013 | Hikari | |
| 2013/0183072 | A1 | 7/2013 | Hase et al. | |
| 2013/0209124 | A1 | 8/2013 | Saito et al. | |
| 2013/0209125 | A1 | 8/2013 | Uchitani et al. | |
| 2013/0209127 | A1* | 8/2013 | Fujimoto | G03G 15/2046 399/69 |
| 2013/0251422 | A1 | 9/2013 | Iwaya | |
| 2013/0343791 | A1 | 12/2013 | Shimura | |
| 2014/0010578 | A1 | 1/2014 | Ishigaya et al. | |
| 2014/0016971 | A1 | 1/2014 | Arai et al. | |
| 2014/0016972 | A1 | 1/2014 | Seshita et al. | |
| 2014/0072355 | A1 | 3/2014 | Tamaki et al. | |
| 2014/0079424 | A1 | 3/2014 | Ikebuchi et al. | |
| 2014/0079453 | A1 | 3/2014 | Arai et al. | |
| 2014/0079455 | A1 | 3/2014 | Seki et al. | |
| 2014/0133879 | A1 | 5/2014 | Seshita et al. | |
| 2014/0169846 | A1 | 6/2014 | Shimura | |
| 2014/0341624 | A1 | 11/2014 | Arai | |
| 2014/0356036 | A1 | 12/2014 | Shimokawa | |
| 2014/0356037 | A1 | 12/2014 | Shimokawa | |

FOREIGN PATENT DOCUMENTS

| | | |
|---|---|---|
| JP | 2004-286922 | 10/2004 |
| JP | 2007-233011 | 9/2007 |
| JP | 2007-334205 | 12/2007 |
| JP | 2010-079309 | 4/2010 |

* cited by examiner

IMAGE FORMING APPARATUS AND IMAGE FORMING METHOD

CROSS-REFERENCE TO RELATED APPLICATION

This patent application is a divisional application of U.S. application Ser. No. 14/564,291, filed Dec. 9, 2014, which is based on and claims priority pursuant to 35 U.S.C. §119 to Japanese Patent Application No. 2013-269802, filed on Dec. 26, 2013, in the Japanese Patent Office, the entire disclosures of each of which are hereby incorporated by reference herein.

BACKGROUND

Technical Field

Exemplary aspects of the present disclosure relate to an image forming apparatus and an image forming method, and more particularly, to an image forming apparatus for forming an image on a recording medium and an image forming method performed by the image forming apparatus.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed member, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed member apply heat and pressure to the recording medium, melting and fixing the toner image on the recording medium.

SUMMARY

This specification describes below an improved image forming apparatus. In one exemplary embodiment, the image forming apparatus includes an endless fixing belt rotatable in a predetermined direction of rotation, a first heater disposed opposite and heating at least a center of the fixing belt in an axial direction thereof, and a second heater disposed opposite and heating at least a lateral end of the fixing belt in the axial direction thereof. A power supply is connected to the first heater and the second heater to supply power to the first heater and the second heater. A guide separably contacts an inner circumferential surface of the lateral end of the fixing belt in the axial direction thereof to guide the fixing belt as the fixing belt rotates. A controller is operatively connected to the power supply to control the power supply. The controller includes a calculator to calculate an elapsed time elapsed after at least one of the first heater and the second heater starts heating the fixing belt. The controller controls the power supply to supply power to the first heater and the second heater such that a power density of the second heater is greater than a power density of the first heater when the elapsed time calculated by the calculator is smaller than a predetermined time.

This specification further describes below an improved image forming apparatus. In one exemplary embodiment, the image forming apparatus includes an endless fixing belt rotatable in a predetermined direction of rotation and an opposed member contacting an outer circumferential surface of the fixing belt to form a fixing nip therebetween through which a recording medium bearing a toner image is conveyed. An abutment contacts the fixing belt in an absorption span of the fixing belt in an axial direction thereof where the abutment absorbs heat from the fixing belt. A first heater is disposed opposite and heats at least an inboard span of the fixing belt inboard from the absorption span in the axial direction thereof. A second heater is disposed opposite and heats at least the absorption span of the fixing belt. A first temperature detector is disposed opposite the opposed member to detect a temperature of the opposed member. A power supply is connected to the first heater and the second heater to supply power to the first heater and the second heater. A controller is operatively connected to the first temperature detector and the power supply to control the power supply. The controller controls the power supply to supply power to the first heater and the second heater such that a power density of the second heater is greater than a power density of the first heater when the temperature of the opposed member detected by the first temperature detector is smaller than a preset first temperature.

This specification further describes an improved image forming method of an image forming apparatus including a fixing device. In one exemplary embodiment, the image forming method includes starting a print job; determining that a difference ΔT between a target fixing temperature and a temperature of a fixing belt is higher than a setting temperature Ta; calculating power available to a first heater for heating a center of the fixing belt in an axial direction thereof and a second heater for heating a lateral end of the fixing belt in the axial direction thereof according to input voltage and an operation condition of a peripheral device of the fixing device; determining that a time t has elapsed after at least one of the first heater and the second heater starts heating the fixing belt; calculating power available to each of the first heater and the second heater based on a reference table for a latter half of the print job; and causing each of the first heater and the second heater to output heat with the calculated power.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
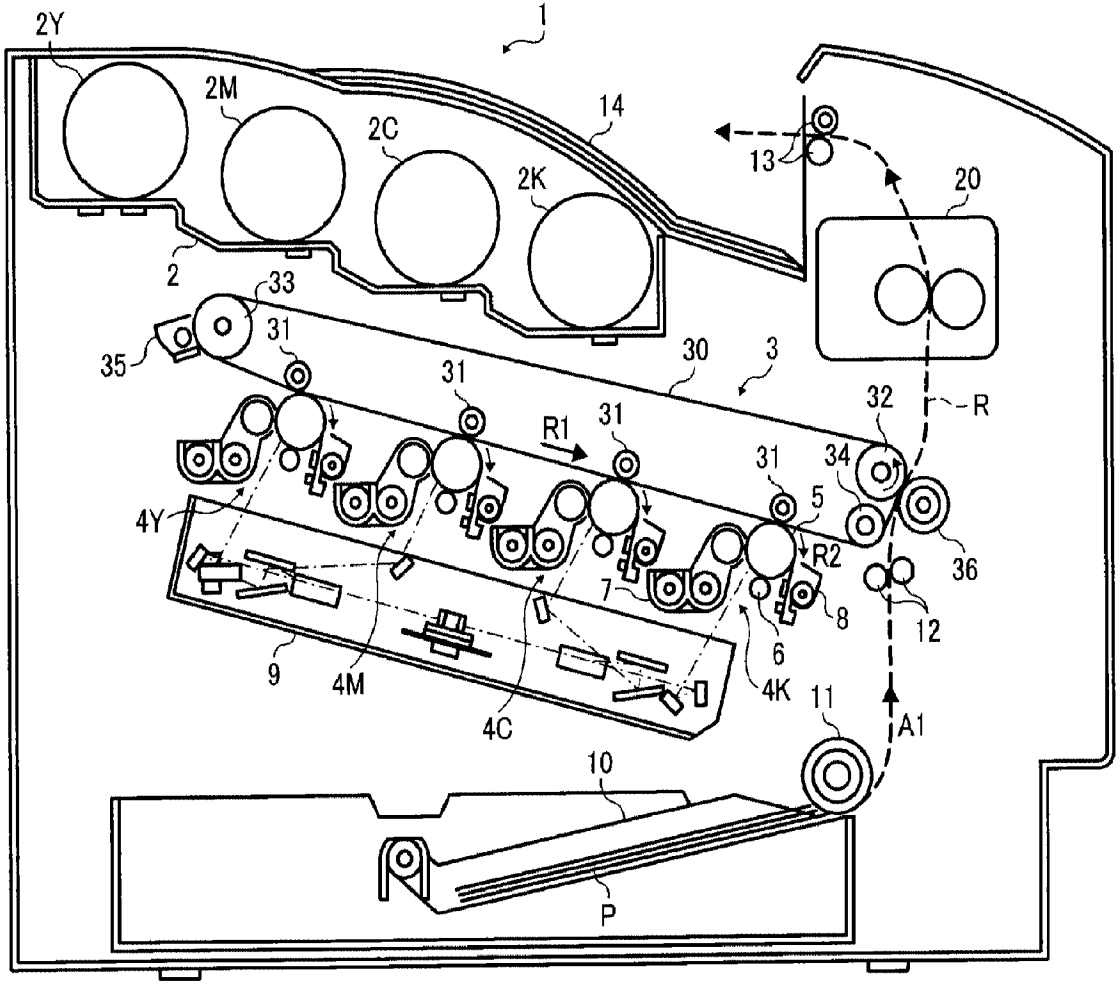
FIG. 1 is a schematic vertical sectional view of an image forming apparatus according to a first exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to a first exemplary embodiment of the present disclosure is explained.

It is to be noted that, in the drawings for explaining exemplary embodiments of this disclosure, identical reference numerals are assigned as long as discrimination is possible to components such as members and component parts having an identical function or shape, thus omitting description thereof once it is described.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography.

With reference to FIG. 1, a description is provided of a construction of the image forming apparatus 1.

As shown in FIG. 1, the image forming apparatus 1 is a color laser printer that includes four image forming devices 4Y, 4M, 4C, and 4K situated in a center portion thereof. Although the image forming devices 4Y, 4M, 4C, and 4K contain yellow, magenta, cyan, and black developers (e.g., yellow, magenta, cyan, and black toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image bearer or a latent image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5.

It is to be noted that, in FIG. 1, reference numerals are assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30, four primary transfer rollers 31, a secondary transfer roller 36, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies at least one of a predetermined direct current (DC) voltage and a predetermined alternating current (AC) voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies at least one of a predetermined direct current (DC) voltage and a predetermined alternating current (AC) voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle housing 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Additionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction A1. The registration roller pair 12 serving as a conveyance member conveys the sheet P conveyed from the feed roller 11 toward the secondary transfer nip.

The conveyance path R is further provided with a fixing device 20 (e.g., a fuser or a fusing unit) located above the secondary transfer nip, that is, downstream from the secondary transfer nip in the sheet conveyance direction A1. The fixing device 20 fixes a toner image transferred from the intermediate transfer belt 30 onto the sheet P conveyed from the secondary transfer nip. The conveyance path R is further provided with the output roller pair 13 located above the fixing device 20, that is, downstream from the fixing device 20 in the sheet conveyance direction A1. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

A description is provided of an image forming operation to form a toner image on a sheet P that is performed by the image forming apparatus 1 having the construction described above.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity.

The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. The developing devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the charged toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30.

After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

As the yellow, magenta, cyan, and black toner images constituting the color toner image on the intermediate transfer belt 30 reach the secondary transfer nip in accordance with rotation of the intermediate transfer belt 30, the transfer electric field created at the secondary transfer nip secondarily transfers the yellow, magenta, cyan, and black toner images from the intermediate transfer belt 30 onto the sheet P collectively. After the secondary transfer of the color toner image from the intermediate transfer belt 30 onto the sheet P, the belt cleaner removes residual toner failed to be transferred onto the sheet P and therefore remaining on the intermediate transfer belt 30 therefrom. The removed toner is conveyed and collected into the waste toner container.

Thereafter, the sheet P bearing the color toner image is conveyed to the fixing device 20 that fixes the color toner image on the sheet P. Then, the sheet P bearing the fixed color toner image is ejected by the output roller pair 13 onto the outside of the image forming apparatus 1, that is, the output tray 14 that stocks the sheet P.

The above describes the image forming operation of the image forming apparatus 1 to form the color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

The image forming apparatus 1 forms the toner image on the sheet P by electrophotography through processes described below. The developing devices 7 visualize electrostatic latent images formed on the photoconductors 5 serving as latent image bearers with yellow, magenta, cyan, and black toners into yellow, magenta, cyan, and black toner images, respectively. The yellow, magenta, cyan, and black toner images are transferred onto the sheet P via the intermediate transfer belt 30 as a color toner image. The fixing device 20 fixes the color toner image on the sheet P, thus completing printing.

A fixing device installable in an image forming apparatus may employ various fixing methods such as a heating roller fixing method, a belt fixing method, a film fixing method, and an electromagnetic induction heating fixing method.

A fixing device employing the heating roller fixing method includes a fixing roller and a pressure roller disposed opposite the fixing roller via a sheet conveyance path and in contact with the fixing roller. The toner image is melted and permeated in the sheet P under heat from a heater situated inside the fixing roller and pressure from the pressure roller. A phenomenon that the toner image is melted and permeated in the sheet P occurs also in the fixing methods described below.

A fixing device employing the belt fixing method or the film fixing method includes a fixing belt serving as a thermal conductor, instead of the fixing roller, a pressure roller, a roller over which the fixing belt is looped, and a heater disposed opposite the fixing belt.

A fixing device employing the electromagnetic induction heating fixing method includes an electromagnetic induction coil that enhances heat generation efficiency and is disposed opposite a heating member.

The fixing devices employing the fixing methods described above are requested to attain advantages below. For example, the fixing devices are requested to shorten a warm-up time and a first print time. The warm-up time defines a time taken to warm up the fixing device from an ambient temperature to a predetermined temperature (e.g., a reload temperature) at which printing is available after the image forming apparatus is powered on. The first print time defines a time taken to eject a sheet P bearing a fixed toner image upon receipt of a print job through preparation for a print operation and the subsequent print operation.

The fixing devices may suffer from fixing failure due to reasons below. The image forming apparatus prints at high speed. As the image forming apparatus is requested to print at high speed by increasing a number of sheets passing through the fixing device per unit time for fixing operation, the fixing device is requested to supply an increased amount of heat to the sheets moving at high speed. It is because the fixing device is requested to supply heat sufficient for fixing to the sheets even when the sheets pass through the fixing device for a shortened time.

However, before a plurality of sheets is conveyed through the fixing device continuously, if the fixing device is heated insufficiently, the fixing device may suffer from substantial temperature decrease. For example, as continuous conveyance of the plurality of sheets starts at high speed before the fixing device is heated sufficiently, the fixing device may suffer from fixing failure.

Since the fixing device installed in the high speed image forming apparatus is requested to convey an increased number of sheets per unit time while supplying an increased amount of heat to the sheets, the fixing device is susceptible to shortage of heat and temperature decrease as continuous conveyance of the plurality of sheets starts, resulting in fixing failure by high speed printing.

In addition to the fixing methods described above, the fixing device employs a surf fixing method using a ceramic heater.

A fixing device employing the surf fixing method includes a heater disposed opposite a fixing belt at a fixing nip formed between the fixing belt and a pressure roller. Accordingly, the heater does heat a portion of the fixing belt disposed opposite the fixing nip but does not heat a portion of the fixing belt not disposed opposite the fixing nip. The fixing device employing the surf fixing method has a decreased thermal capacity and is downsized compared to the fixing device employing the belt fixing method, shortening the warm-up time and the first print time. However, the fixing device may cause a disadvantage below.

For example, since the portion of the fixing belt not disposed opposite the fixing nip is not heated, the fixing belt is cool at a portion thereof disposed opposite an entry to the fixing nip where a sheet enters the fixing nip and therefore is susceptible to fixing failure. If the fixing device is installed in the high speed image forming apparatus, as the fixing belt rotates at high speed, the fixing belt dissipates an increased amount of heat at the portion thereof not disposed opposite the fixing nip and therefore is more susceptible to fixing failure.

To address this circumstance, a fixing device incorporating a fixing belt may have constructions described below with reference to FIGS. 2 and 3 to achieve a desired fixing property of being heated quickly, even if the fixing device is installed in the high speed image forming apparatus attaining increased productivity.

Figure 2:
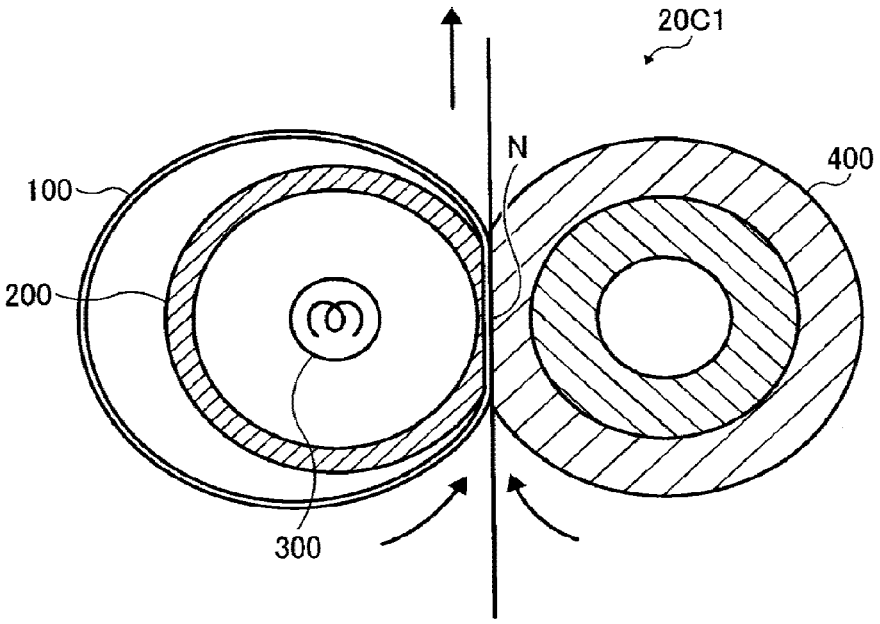
FIG. 2 is a schematic vertical sectional view of a comparative fixing device.

FIG. 2 is a schematic vertical sectional view of a comparative fixing device 20C1. As shown in FIG. 2, the comparative fixing device 20C1 includes a fixing belt 100, a tubular, metal thermal conductor 200 disposed inside a loop formed by the fixing belt 100, a heater 300 disposed inside the metal thermal conductor 200, and a pressure roller 400 pressed against the metal thermal conductor 200 via the fixing belt 100 to form a fixing nip N between the fixing belt 100 and the pressure roller 400.

As the pressure roller 400 rotates clockwise in FIG. 2, the fixing belt 100 rotates counterclockwise in FIG. 2 in accordance with rotation of the pressure roller 400 by friction therebetween. As the fixing belt 100 rotates, the metal thermal conductor 200 guides the fixing belt 100. As the heater 300 situated inside the metal thermal conductor 200 heats the fixing belt 100 via the tubular metal thermal conductor 200, the fixing belt 100 is heated entirely. Hence, the comparative fixing device 20C1 shortens the first print time from a standby state for heating and overcomes shortage of heat during high speed rotation of the fixing belt 100.

However, in order to save energy and shorten the first print time further, the comparative fixing device 20C1 is requested to improve heating efficiency further.

Figure 3:
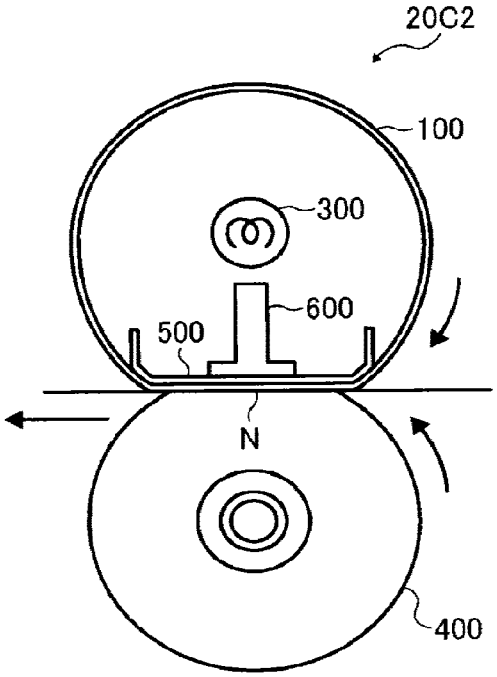
FIG. 3 is a schematic vertical sectional view of another comparative fixing device.

FIG. 3 is a schematic vertical sectional view of a comparative fixing device 20C2. As shown in FIG. 3, the comparative fixing device 20C2 includes the fixing belt 100, the pressure roller 400 contacting an outer circumferential surface of the fixing belt 100, and a nip formation member 500 pressing against the pressure roller 400 via the fixing belt 100 to form the fixing nip N between the fixing belt 100 and the pressure roller 400. The nip formation member 500 is supported by a support 600 made of stainless steel or the like to enhance the mechanical strength of the nip formation member 500 against pressure from the pressure roller 400.

The heater 300 is disposed opposite an inner circumferential surface of the fixing belt 100 to heat the fixing belt 100 with radiation heat throughout the entire width in an axial direction of the fixing belt 100. The heater 300 heats the fixing belt 100 directly with radiation heat in a circumferential span of the fixing belt 100 outboard from the nip formation member 500, improving efficiency in heat conduction from the heater 300 to the fixing belt 100 substantially. Hence, the comparative fixing device 20C2 decreases power consumption and shortens the first print time from the standby state for heating the fixing belt 100 further. Additionally, the comparative fixing device 20C2 reduces manufacturing costs by not incorporating the metal thermal conductor 200 shown in FIG. 2.

However, since the fixing belt 100 has a decreased loop diameter of about 30 mm to improve heating efficiency, the support 600 disposed inside the loop formed by the fixing belt 100 is also downsized. Accordingly, the nip formation member 500 has an insufficient mechanical strength. Consequently, when the nip formation member 500 is bent by pressure from the pressure roller 400, surface pressure distribution and a nip length of the fixing nip N may vary, resulting in fixing failure.

Figure 4:
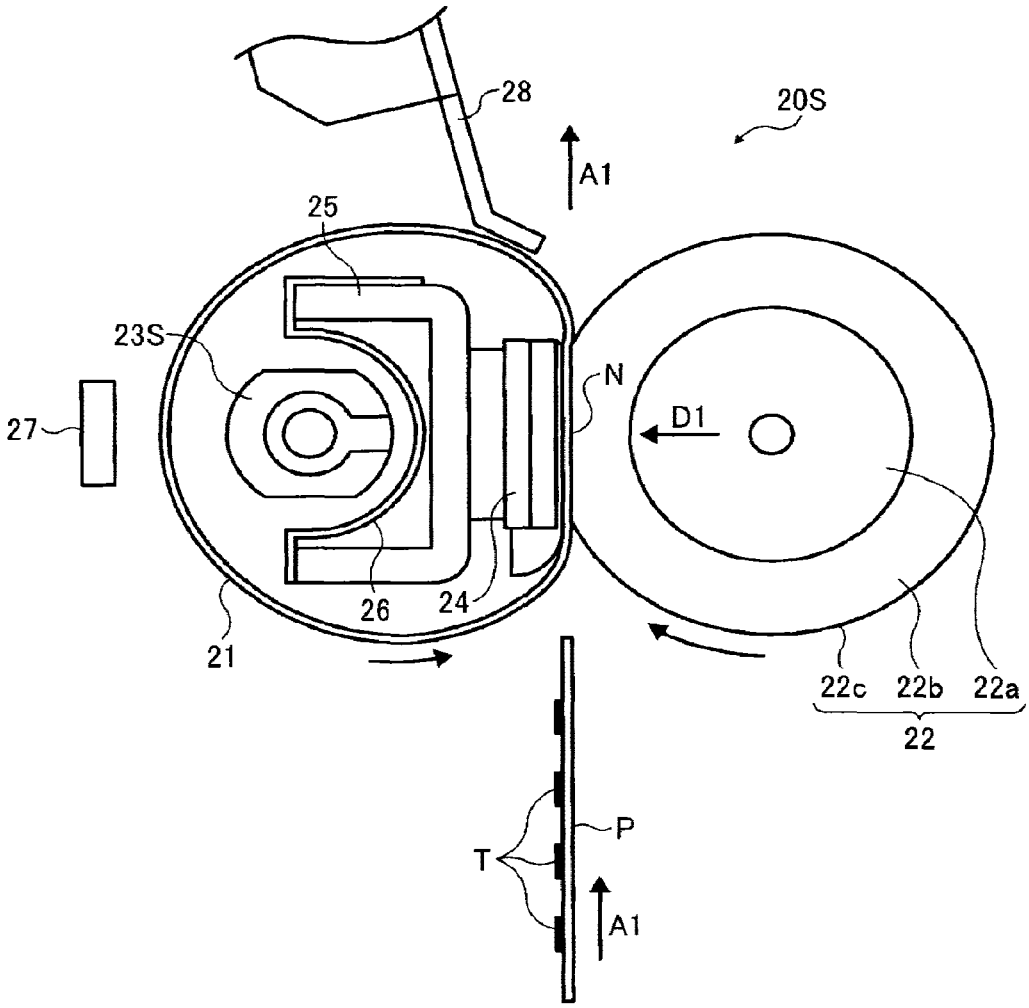
FIG. 4 is a schematic vertical sectional view of a fixing device installable in the image forming apparatus shown in FIG. 1.

To address this circumstance, the comparative fixing device 20C2 may be modified to have a construction to suppress bending of the nip formation member 500 as shown in FIG. 4.

FIG. 4 is a schematic vertical sectional view of a fixing device 20S (e.g., a fuser) installable in the image forming apparatus 1 depicted in FIG. 1. As shown in FIG. 4, the fixing device 20S includes a fixing belt 21; a pressure roller 22 pressed against a nip formation pad 24 via the fixing belt 21 to form a fixing nip N between the fixing belt 21 and the pressure roller 22 through which a sheet P bearing a toner image T is conveyed; a halogen heater 23S disposed inside a loop formed by the fixing belt 21 to heat the fixing belt 21; a reflector 26 disposed opposite the halogen heater 23S to reflect light radiated from the halogen heater 23S toward the fixing belt 21; a temperature sensor 27 disposed outside the loop formed by the fixing belt 21 to detect the temperature of the fixing belt 21; and a separator 28 disposed opposite the fixing belt 21 to separate the sheet P discharged from the fixing nip N from the fixing belt 21. The fixing device 20S further includes a stay 25 serving as a support that supports the nip formation pad 24. The stay 25 has an enhanced mechanical strength to suppress bending of the nip formation pad 24 further. The stay 25 includes arms projecting in a pressurization direction D1 in which the pressure roller 22 exerts pressure to the fixing belt 21. A tip of the respective arms is disposed in proximity to an inner circumferential surface of the fixing belt 21 in the pressurization direction D1 of the pressure roller 22.

Accordingly, the arms of the stay 25 are elongated in the pressurization direction D1 of the pressure roller 22, enhancing the mechanical strength of the stay 25. Consequently, the stay 25 suppresses bending of the nip formation pad 24 precisely as the pressure roller 22 is pressed against the nip formation pad 24 via the fixing belt 21, producing the fixing nip N having an even length in the sheet conveyance direction A1 throughout the entire width of the pressure roller 22 in an axial direction thereof and resulting in formation of the desired toner image T on the sheet P.

In order to enhance the mechanical strength of the stay 25 further, the stay 25 has a substantially closed shape in cross-section in a direction perpendicular to a longitudinal direction, that is, an axial direction, of the fixing belt 21. Accordingly, the stay 25 has an increased rigidity that suppresses bending of the nip formation pad 24 precisely against pressure from the pressure roller 22 pressed against the nip formation pad 24 via the fixing belt 21.

Figure 5:
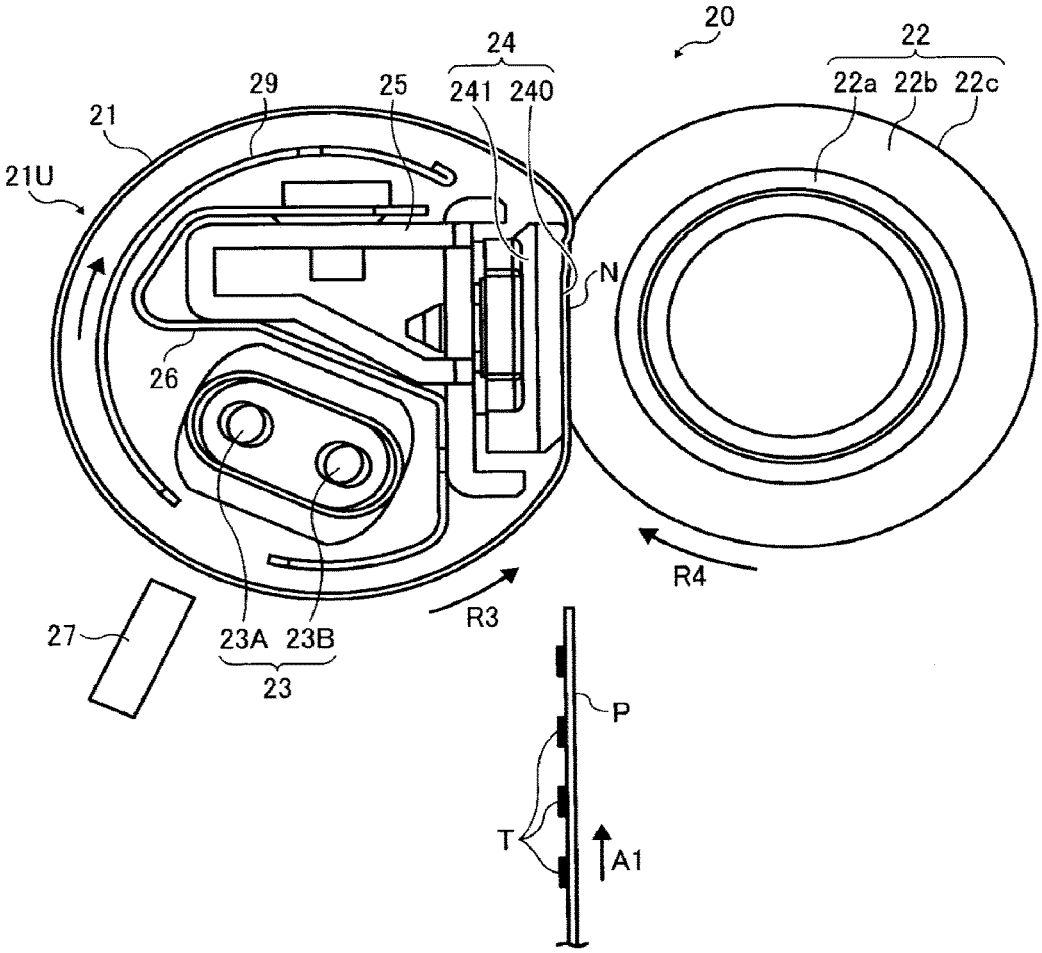
FIG. 5 is a schematic vertical sectional view of a fixing device installed in the image forming apparatus shown in FIG. 1.

With reference to FIG. 5, a description is provided of a construction of the fixing device 20 installed in the image forming apparatus 1 depicted in FIG. 1.

FIG. 5 is a schematic vertical sectional view of the fixing device 20. As shown in FIG. 5, the fixing device 20 includes the fixing belt 21 serving as a fixing rotator, an endless belt, or a fixing member, that is, a hollow endless moving body rotatable in a rotation direction R3 and the pressure roller 22 serving as a pressure rotator, an opposed member, or a pressure member, that is, an opposed rotator disposed opposite the fixing belt 21 and rotatable in a rotation direction R4.

Inside the loop formed by the fixing belt 21 are a halogen heater pair 23 serving as a heater for heating the fixing belt 21 and the nip formation pad 24 pressing against the pressure roller 22 via the fixing belt 21 to form the fixing nip N between the fixing belt 21 and the pressure roller 22. Further, inside the loop formed by the fixing belt 21 are the stay 25 serving as a support for supporting the nip formation pad 24 and the reflector 26 for reflecting light radiated from the halogen heater pair 23 toward the fixing belt 21.

The fixing device 20 further includes the temperature sensor 27 serving as a temperature detector disposed opposite an outer circumferential surface of the fixing belt 21 to detect the temperature of the fixing belt 21, a heat shield 29 interposed between the halogen heater pair 23 and the fixing belt 21 to shield the fixing belt 21 from the halogen heater pair 23, and a pressurization member for pressing the pressure roller 22 against the fixing belt 21. The fixing belt 21 and the components disposed inside the loop formed by the fixing belt 21, that is, the halogen heater pair 23, the nip formation pad 24, the stay 25, the reflector 26, and the heat shield 29, may constitute a belt unit 21U separably coupled with the pressure roller 22.

A flange serving as a belt holder is inserted into each lateral end of the fixing belt 21 in the axial direction thereof to rotatably support the fixing belt 21. The flange, the halogen heater pair 23, and the stay 25 are mounted on and supported by a side plate of the fixing device 20 at each lateral end of the flange, the halogen heater pair 23, and the stay 25.

A detailed description is now given of a construction of the fixing belt 21.

The fixing belt 21 is a thin, flexible endless belt or film. The fixing belt 21 includes a base layer constituting the inner circumferential surface of the fixing belt 21 and made of metal such as nickel and stainless steel or resin such as polyimide (PI). The fixing belt 21 further includes a release layer constituting the outer circumferential surface of the fixing belt 21 and made of tetrafluoroethylene-perfluoroalkylvinylether copolymer (PFA), polytetrafluoroethylene (PTFE), or the like. Optionally, an elastic layer made of rubber such as silicone rubber may be interposed between the base layer and the release layer.

If the fixing belt 21 does not incorporate the elastic layer, the fixing belt 21 has a decreased thermal capacity that improves a fixing property of being heated quickly. However, as the pressure roller 22 and the fixing belt 21 sandwich and press the toner image T on the sheet P passing through the fixing nip N, slight surface asperities of the fixing belt 21 may be transferred onto the toner image T on the sheet P, producing an orange peel mark on the solid toner image T on the sheet P. To address this problem, it is preferable that the fixing belt 21 incorporates the elastic layer having a thickness not smaller than about 100 micrometers. The elastic layer having the thickness not smaller than about 100 micrometers elastically deforms to absorb slight surface asperities of the fixing belt 21, suppressing formation of the orange peel mark on the solid toner image T on the sheet P.

A detailed description is now given of a construction of the pressure roller 22.

The pressure roller 22 is constructed of a cored bar 22*a* (e.g., a core metal), an elastic layer 22*b*, and a release layer 22*c*. The elastic layer 22*b* coats the cored bar 22*a* and is made of silicone rubber foam, silicone rubber, fluoro rubber, or the like. The release layer 22*c* coats the elastic layer 22*b* and is made of PFA, PTFE, or the like.

A spring serving as a pressurization member presses the pressure roller 22 against the nip formation pad 24 via the fixing belt 21. Thus, the pressure roller 22 pressingly contacting the fixing belt 21 deforms the elastic layer 22*b* of the pressure roller 22 at the fixing nip N formed between the pressure roller 22 and the fixing belt 21, thus creating the fixing nip N having a predetermined length in the sheet conveyance direction A1.

A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 by friction between the pressure roller 22 and the fixing belt 21. Alternatively, the driver may also be connected to the fixing belt 21 to drive and rotate the fixing belt 21.

As shown in FIG. 5, according to this exemplary embodiment, the pressure roller 22 is a solid roller. Alternatively, the pressure roller 22 may be a hollow roller. In this case, a heater such as a halogen heater may be disposed inside the hollow roller.

The elastic layer 22*b* may be made of solid rubber. Alternatively, if no heater is situated inside the pressure roller 22, the elastic layer 22*b* may be made of sponge rubber. The sponge rubber is more preferable than the solid rubber because it has an increased insulation that draws less heat from the fixing belt 21. According to this exemplary embodiment, the pressure roller 22 is pressed against the fixing belt 21. Alternatively, the pressure roller 22 may merely contact the fixing belt 21 with no pressure therebetween.

A detailed description is now given of a configuration of the halogen heater pair 23.

The halogen heater pair 23 is disposed opposite the inner circumferential surface of the fixing belt 21 and upstream from the fixing nip N in the sheet conveyance direction A1.

The halogen heater pair 23 heats the fixing belt 21 directly with light or radiation heat and includes two halogen heaters having different heat generation spans, respectively. With the different heat generation spans of the halogen heater pair 23, the halogen heater pair 23 heats the fixing belt 21 in various spans in the axial direction thereof that correspond to various widths of sheets P.

A description is provided of a configuration of the halogen heater pair 23 installed in the fixing device 20 mainly directed to sheets P of letter (LT) sizes.

The halogen heater pair 23 includes halogen heaters 23A and 23B. The halogen heater 23A serving as a first heater has a heat generation span disposed opposite and heating a center of the fixing belt 21 in the axial direction thereof, that is, a center conveyance span over which sheets P of a letter size in portrait orientation (e.g., an LTT size) or smaller are conveyed. The halogen heater 23B serving as a second heater has a heat generation span disposed opposite and heating each lateral end of the fixing belt 21 in the axial direction thereof, that is, a lateral end conveyance span over which sheets P of an A3 size in portrait orientation (e.g., an A3T size) are conveyed. The A3T size is greater than the LTT size in the axial direction of the fixing belt 21. Each of the halogen heaters 23A and 23B is mounted on the side plate of the fixing device 20 at each lateral end of the halogen heaters 23A and 23B in the axial direction of the fixing belt 21.

In a print job for printing on a sheet P of the LTT size or smaller, the halogen heater 23A is turned on and the halogen heater 23B is turned off. In a print job for printing on a sheet P of the A3T size, both the halogen heater 23A and the halogen heater 23B are turned on.

Although a description of printing on a sheet P of the LTT size or smaller is deferred, the above description is also applicable to printing on a sheet P smaller than the LTT size sheet P.

As a power supply situated inside the image forming apparatus 1 depicted in FIG. 1 supplies power to the halogen heaters 23A and 23B, the halogen heaters 23A and 23B generate heat under output control. For example, output control of the halogen heaters 23A and 23*b* is performed by the power supply based on the temperature of the outer circumferential surface of the fixing belt 21 detected by the temperature sensor 27 so as to control turning on and off of the halogen heaters 23A and 23B or the amount of power supply to the halogen heaters 23A and 23B. Thus, the temperature of the fixing belt 21 is adjusted to a desired fixing temperature.

Alternatively, instead of the halogen heaters 23A and 23B, an electromagnetic induction heater (IH), a resistance heat generator, a ceramic heater, a carbon heater, or the like may be employed as a heater that heats the fixing belt 21.

Instead of the temperature sensor 27 that detects the temperature of the fixing belt 21, a temperature sensor that detects the temperature of the pressure roller 22 may be disposed opposite the pressure roller 22 so that the temperature of the fixing belt 21 is estimated based on a temperature of the pressure roller 22 detected by the temperature sensor.

A detailed description is now given of a construction of the nip formation pad 24.

The nip formation pad 24 includes a base pad 241 and a low-friction slide sheet 240 disposed on an opposed face of the base pad 241 disposed opposite the fixing belt 21. The base pad 241 extends in a longitudinal direction thereof parallel to the axial direction of the fixing belt 21 or the pressure roller 22.

As the base pad 241 is exerted with pressure from the pressure roller 22, the base pad 241 defines the shape of the fixing nip N. According to this exemplary embodiment, the fixing nip N is planar. Alternatively, the fixing nip N may define a recess, a curve, or other shapes. If the fixing nip N defines a recess or a curve, the curved fixing nip N directs a leading edge of the sheet P toward the pressure roller 22 as the sheet P is discharged from the fixing nip N, facilitating separation of the sheet P from the fixing belt 21 and suppressing jamming of the sheet P.

As the fixing belt 21 rotating in the rotation direction R3 slides over the base pad 241, the slide sheet 240 decreases friction between the fixing belt 21 and the base pad 241. If the base pad 241 is made of a low-friction material, the slide sheet 240 may not be interposed between the fixing belt 21 and the base pad 241.

The base pad 241 is made of a heat resistant material resistant against temperatures of about 200 degrees centigrade or higher, preventing thermal deformation of the nip formation pad 24 at temperatures in a fixing temperature range desirable to fix the toner image T on the sheet P and thereby retaining the shape of the fixing nip N and quality of the toner image T formed on the sheet P.

For example, the base pad 241 is made of general heat resistant resin such as polyether sulfone (PES), polyphenylene sulfide (PPS), liquid crystal polymer (LCP), polyether nitrile (PEN), polyamide imide (PAI), and polyether ether ketone (PEEK).

The base pad 241 is mounted on and supported by the stay 25. Accordingly, even if the nip formation pad 24 receives pressure from the pressure roller 22, the nip formation pad 24 is not bent by the pressure and therefore produces an even nip length throughout the entire width of the pressure roller 22 in the axial direction thereof.

A detailed description is now given of a configuration of the stay 25.

The stay 25 is made of metal having an increased mechanical strength, such as stainless steel and iron, to prevent bending of the nip formation pad 24. The base pad 241 is made of a rigid material to secure the mechanical strength of the nip formation pad 24. For example, the base pad 241 is made of resin such as LCP, metal, ceramic, or the like.

If the stay 25 is susceptible to heating by radiation heat from the halogen heater pair 23, the stay 25 may be treated with insulation or mirror finishing to prevent the stay 25 from being heated by the halogen heater pair 23 and suppress waste of energy.

A detailed description is now given of a configuration of the reflector 26.

The reflector 26 is mounted on and supported by the stay 25 such that the reflector 26 is disposed opposite the halogen heater pair 23. The reflector 26 reflects hear or light radiated from the halogen heater pair 23 toward the fixing belt 21, suppressing conduction of heat from the halogen heater pair 23 to the stay 25 and the like and thereby heating the fixing belt 21 effectively and saving energy.

The reflector 26 is made of aluminum, stainless steel, or the like. If the reflector 26 is constructed of an aluminum base treated with vapor deposition of silver having a decreased emissivity and a decreased reflectance, the reflector 26 enhances heating efficiency for heating the fixing belt 21.

Alternatively, instead of installation of the reflector 26, an opposed face of the stay disposed opposite the halogen heater pair 23 may be treated with polishing or mirror finishing such as coating to produce a reflection face that reflects light from the halogen heater pair 23 toward the fixing belt 21.

The shape and the material of the stay 25 are not selected flexibly to retain the mechanical strength thereof. Accordingly, if the reflector 26 is separately provided from the stay 25 as in this exemplary embodiment, the reflector 26 and the stay 25 provide flexibility in the shape and the material, attaining properties peculiar to them, respectively. The reflector 26 interposed between the halogen heater pair 23 and the stay 25 is situated in proximity to the halogen heater pair 23, reflecting light from the halogen heater pair 23 toward the fixing belt 21 effectively.

A detailed description is now given of a configuration of the heat shield 29.

The heat shield 29 is interposed between the halogen heater pair 23 and the fixing belt 21 at each lateral end of the fixing belt 21 in the axial direction thereof to shield the fixing belt 21 from the halogen heater pair 23. For example, even if a plurality of small sheets P is conveyed over the fixing belt 21 continuously, the heat shield 29 prevents overheating of a non-conveyance span of the fixing belt 21 where the small sheets S are not conveyed over the fixing belt 21 and therefore do not draw heat from the fixing belt 21, thus preventing thermal degradation and damage of the fixing belt 21.

The heat shield 29 is manufactured by contouring a metal plate having a thickness in a range of from about 0.1 mm to about 1.0 mm into an arch in cross-section along the inner circumferential surface of the fixing belt 21. The heat shield 29 is movable in a circumferential direction of the fixing belt 21 as needed.

The heat shield 29 produces a circumferential, direct heating span of the fixing belt 21 where the heat shield 29 is not interposed between the halogen heater pair 23 and the fixing belt 21 to allow the halogen heater pair 23 to be disposed opposite the fixing belt 21 directly and heat the fixing belt 21. Conversely, the components other than the heat shield 29, that is, the stay 25, the nip formation pad 24, the reflector 26, and the like, are interposed between the halogen heater pair 23 and the fixing belt 21 to produce a circumferential, indirect heating span of the fixing belt 21 where the halogen heater pair 23 does not heat the fixing belt 21 directly.

Figure 6:
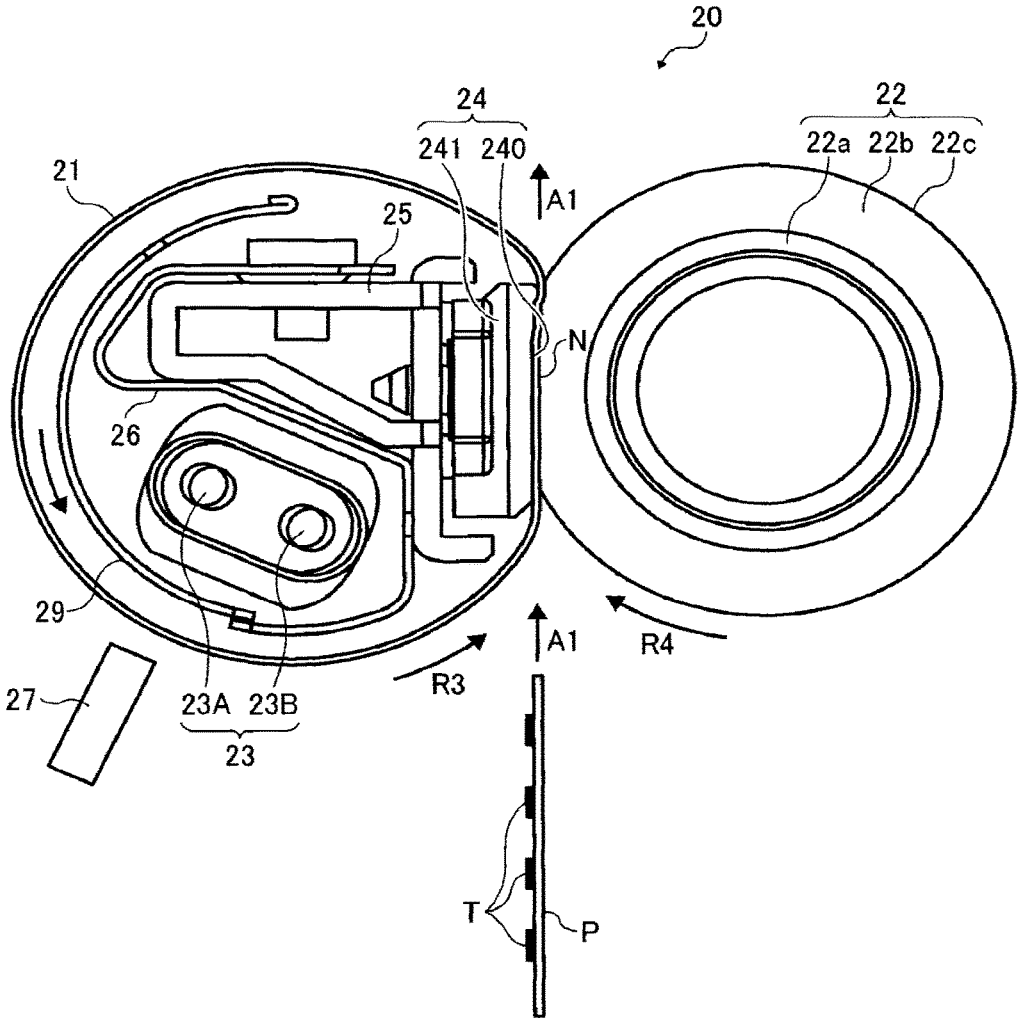
FIG. 6 is a schematic vertical sectional view of the fixing device shown in FIG. 5 illustrating a heat shield situated at a shield position.

FIG. 6 is a schematic vertical sectional view of the fixing device 20 illustrating the heat shield 29 situated at a shield position to shield the fixing belt 21 from the halogen heater pair 23. As shown in FIG. 6, when the heat shield 29 is requested to shield the fixing belt 21 from the halogen heater pair 23, the heat shield 29 moves to the shield position where the heat shield 29 is disposed opposite the circumferential, direct heating span of the fixing belt 21. Conversely, as shown in FIG. 5, when the heat shield 29 is not requested to shield the fixing belt 21 from the halogen heater pair 23, the heat shield 29 moves to a retracted position where the heat shield 29 is disposed opposite the circumferential, indirect heating span of the fixing belt 21 and situated behind the reflector 26 and the stay 25.

Since the heat shield 29 is requested to be heat resistant, the heat shield 29 is made of metal such as aluminum, iron, and stainless steel or ceramic.

Figure 7A:
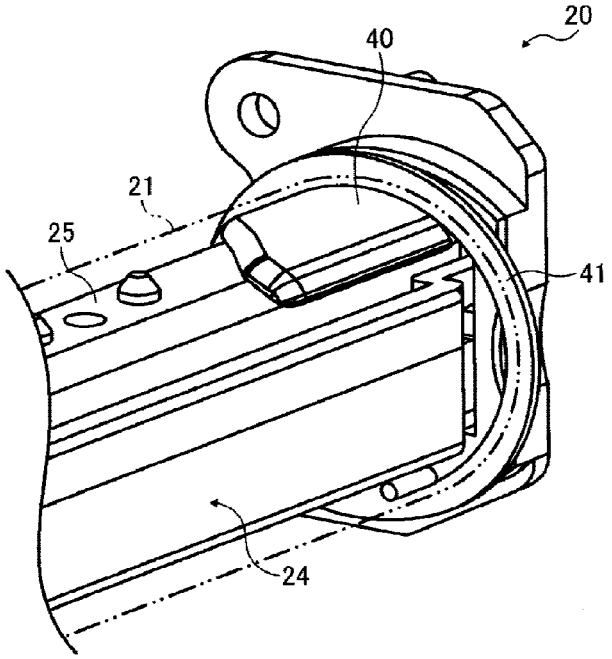
FIG. 7A is a partial perspective view of one lateral end of the fixing device shown in FIG. 5 in an axial direction of a fixing belt incorporated therein.
Figure 7B:
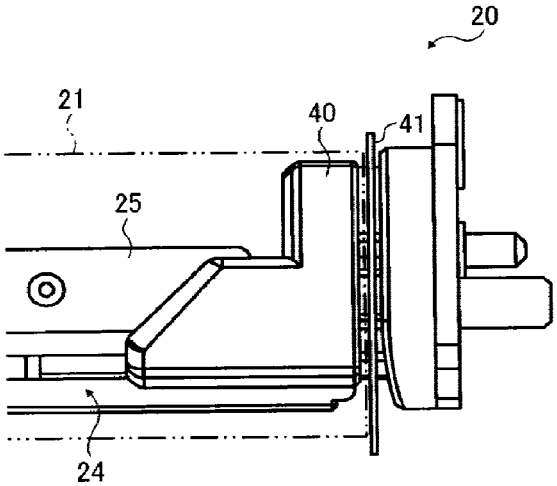
FIG. 7B is a plan view of one lateral end of the fixing device shown in FIG. 7A in the axial direction of the fixing belt.
Figure 7C:
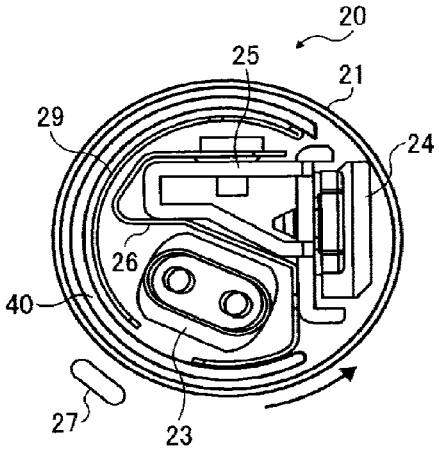
FIG. 7C is a vertical sectional view of one lateral end of the fixing device shown in FIG. 7A in the axial direction of the fixing belt.

With reference to FIGS. 7A, 7B, and 7C, a description is provided of components provided at each lateral end of the fixing device 20 in the axial direction of the fixing belt 21.

FIG. 7A is a partial perspective view of one lateral end of the fixing device 20 in the axial direction of the fixing belt 21. FIG. 7B is a plan view of one lateral end of the fixing device 20 in the axial direction of the fixing belt 21. FIG. 7C is a vertical sectional view of one lateral end of the fixing device 20 in the axial direction of the fixing belt 21 that is outboard from the fixing nip N.

FIGS. 7A, 7B, and 7C illustrate one lateral end of the fixing device 20 in the axial direction of the fixing belt 21. However, since another lateral end of the fixing device 20 in the axial direction of the fixing belt 21 has a construction similar to that of one lateral end of the fixing device 20 in the axial direction of the fixing belt 21, a description is provided below of a configuration of one lateral end of the fixing device 20 in the axial direction of the fixing belt 21 with reference to FIGS. 7A, 7B, and 7C.

As shown in FIGS. 7A and 7B, a flange 40 serving as a guide is inserted into a lateral end of the fixing belt 21 in the axial direction thereof. The flange 40 separably contacts the inner circumferential surface of the lateral end of the fixing belt 21 in the axial direction thereof to guide the fixing belt 21 as it rotates. Hence, the fixing belt 21 rotates on a predetermined locus stably. The flange 40 is constructed of a skew prevention guide that prevents skew of the fixing belt 21 and a rotation guide that guides the fixing belt 21 as it rotates.

As shown in FIG. 7C, the flange 40 has a C-shape in cross-section producing a slit at the fixing nip N where the nip formation pad 24 is disposed. As shown in FIGS. 7A and 7B, each lateral end of the stay 25 in a longitudinal direction thereof parallel to the axial direction of the fixing belt 21 is mounted on the flange 40, thus being positioned inside the loop formed by the fixing belt 21.

As shown in FIGS. 7A and 7B, a slip ring 41 is interposed between a lateral edge face of the fixing belt 21 and an opposed face of the flange 40 disposed opposite the lateral edge face of the fixing belt 21, thus serving as a protector that protects a lateral end of the fixing belt 21 in the axial direction thereof.

Since the skew prevention guide of the flange 40 is not rotatable, as it contacts the lateral end of the fixing belt 21, the fixing belt 21 may suffer from abrasion as it rotates and slides over the flange 40. To address this circumstance, the slip ring 41 rotatable in accordance with rotation of the fixing belt 21 is interposed between the fixing belt 21 and the skew prevention guide of the flange 40. Accordingly, even if the fixing belt 21 is skewed in the axial direction thereof, the slip ring 41 prevents the lateral end of the fixing belt 21 from coming into direct contact with the skew prevention guide of the flange 40, preventing abrasion and breakage of the lateral end of the fixing belt 21.

The slip ring 41 is loosely fitted onto an outer circumferential surface of the flange 40. Hence, as the lateral end of the fixing belt 21 contacts the slip ring 41, the slip ring 41 is rotatable in accordance with rotation of the fixing belt 21. Alternatively, the slip ring 41 may not be rotatable in accordance with rotation of the fixing belt 21 and therefore may be stationary.

For example, the slip ring 41 is made of heat resistant super engineering plastic such as PEEK, PPS, PAI, and PTFE.

The flange 40, the halogen heater pair 23, and the stay 25 are mounted on and supported by the side plates of the fixing device 20.

According to this exemplary embodiment, the flange 40 and the nip formation pad 24 contact the inner circumferential surface of the fixing belt 21. There is no other belt guide that contacts the inner circumferential surface of the fixing belt 21 to guide the fixing belt 21 as it rotates.

The flange 40 serving as a guide separably contacting the inner circumferential surface of the fixing belt 21 at each lateral end of the fixing belt 21 in the axial direction thereof guides the fixing belt 21 as it rotates, facilitating stable rotation of the fixing belt 21 on a predetermined locus.

During warm-up when the halogen heater pair 23 heats the fixing belt 21 to the predetermined fixing temperature, not only the fixing belt 21 but also the interior of the fixing device 20 is heated by radiation of heat from the fixing belt 21.

However, if the halogen heater pair 23 heats the fixing belt 21 directly to shorten the warm-up time, a print job may start before the interior of the fixing device 20 is heated sufficiently. During an initial period of the print job when printing is performed on several sheets P continuously upon start of the print job, the flange 40 may draw heat from each lateral end of the fixing belt 21 in the axial direction thereof. Accordingly, during the initial period of the print job, each lateral end of the fixing belt 21 in the axial direction thereof may suffer from substantial temperature decrease.

Conversely, during a latter half of the print job when printing is performed on another plurality of sheets P continuously after the initial period of the print job, the interior of the fixing device 20 is heated sufficiently by radiation of heat from the fixing belt 21 or the like as printing progresses. Accordingly, heat is not drawn from each lateral end of the fixing belt 21 in the axial direction thereof to the flange 40 readily and therefore each lateral end of the fixing belt 21 in the axial direction thereof is immune from substantial temperature decrease.

That is, if the halogen heater pair 23 heats the fixing belt 21 during warm-up and the initial period of the print job in a method similar to that during the latter half of the print job, each lateral end of the fixing belt 21 in the axial direction thereof may suffer from shortage of heat during the initial period of the print job, which may result in fixing failure.

A description is provided of a control of the fixing device 20 incorporated in the image forming apparatus 1 depicted in FIG. 1.

Figure 8:
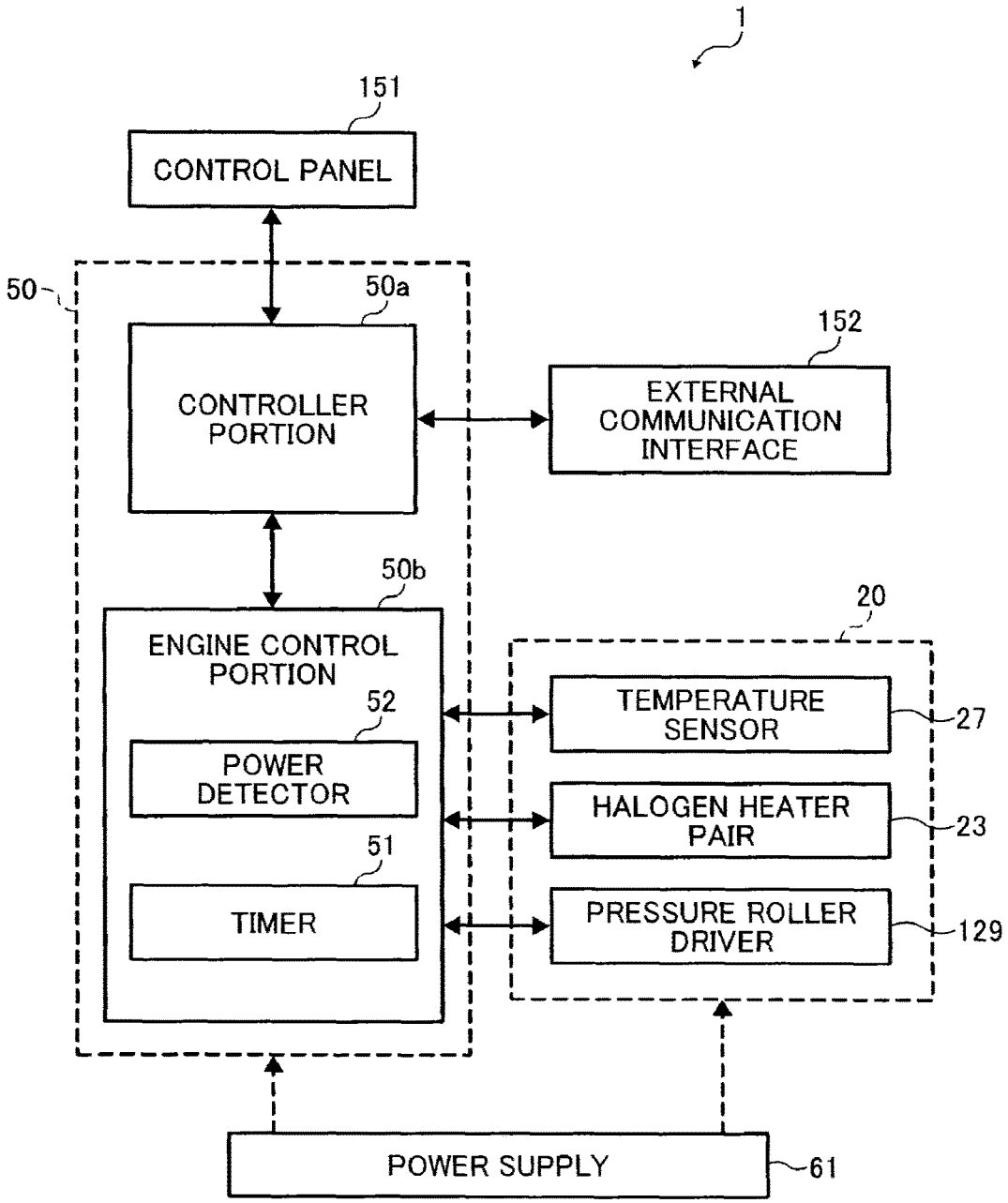
FIG. 8 is a block diagram illustrating one example of a main section of a control system that controls the fixing device shown in FIG. 5.

FIG. 8 is a block diagram illustrating one example of a main section of a control system that controls the fixing device 20. As shown in FIG. 8, the image forming apparatus 1 includes a controller 50 (e.g., a processor) constructed of a controller portion 50*a* and an engine control portion 50*b*. The image forming apparatus 1 further includes a power supply 61 that supplies power to various components of the image forming apparatus 1 including the halogen heater pair 23.

A detailed description is now given of a configuration of the controller portion 50*a*.

The controller portion 50*a* includes a central processing unit (CPU), a random access memory (RAM), and a read-only memory (ROM) and is connected to the engine control portion 50*b*, a control panel 151, an external communication interface 152, and the like. The controller portion 50*a*, by executing a control program preinstalled, controls the entire image forming apparatus 1 and input from the external communication interface 152 and the control panel 151.

For example, the controller portion 50*a* receives an instruction input by a user through the control panel 151 and performs various processes according to the instruction.

Further, the controller portion 50*a* receives a print job and image data from an external device such as a client computer through the external communication interface 152 and controls the engine control portion 50*b*, thus controlling an image forming operation to form a color toner image or a monochrome toner image on a sheet P and output the sheet P bearing the toner image onto the outside of the image forming apparatus 1.

A detailed description is now given of a configuration of the engine control portion 50*b*.

The engine control portion 50*b*, by executing the control program preinstalled, controls a printer engine of the image forming devices 4Y, 4M, 4C, and 4K, the exposure device 9, and the fixing device 20 that performs image forming processes according to an instruction from the controller portion 50*a*.

The engine control portion 50*b* includes a power detector 52 that detects power available to the halogen heater pair 23 and a timer 51 serving as a calculator that calculates an elapsed time elapsed after the halogen heater pair 23 starts heating the fixing belt 21.

For example, the engine control portion 50*b*, in an image formation mode, controls power supply to the halogen heater pair 23 to heat the fixing belt 21 to a target temperature based on a temperature of the fixing belt 21 detected by the temperature sensor 27 and controls a pressure roller driver 129 that drives the pressure roller 22.

A description is provided of three modes of the image forming apparatus 1, that is, the image formation mode, a standby mode, and a sleep mode.

The image formation mode defines a state in which the image forming apparatus 1 performs the image forming processes described above. The standby mode defines a state in which the image forming apparatus 1 waits for an instruction to start the image forming processes. The sleep mode defines a state in which the image forming apparatus 1 consumes less power than in the standby mode.

In the image formation mode, after the fixing device 20 performs a warm-up process to heat the fixing belt 21 to a predetermined target fixing temperature in a range of from about 158 degrees centigrade to about 170 degrees centigrade, the fixing device 20 performs a fixing process to fix the toner image T on the sheet P.

In the standby mode, the temperature of the fixing belt 21 is retained at a predetermined decreased temperature of about 90 degrees centigrade that is lower than the target fixing temperature in the image formation mode. In the sleep mode, power supply to the printer engine of the fixing device 20 and the like and the engine control portion 50*b* is interrupted to prohibit power supply to the halogen heater pair 23 and driving and rotation of the pressure roller 22.

A description is provided of examples of control of the halogen heater pair 23 of the fixing device 20 incorporated in the image forming apparatus 1.

It is to be noted that, in the exemplary embodiments of this disclosure, a power density is defined by a formula (1) below at a center and each lateral end of the fixing belt 21 in the axial direction thereof. As the power density increases, the halogen heater pair 23 heats the center and each lateral end of the fixing belt 21 in the axial direction thereof with an increased amount of heat.

$$D=W/L \quad (1)$$

In the formula (1), D represents a power density. W represents an amount of power supplied to a specific part of the halogen heater pair 23. L represents a length of the specific part of the halogen heater pair 23 in a longitudinal direction thereof parallel to the axial direction of the fixing belt 21.

A detailed description is now given of a first example of control of the halogen heater pair 23.

Figure 9:
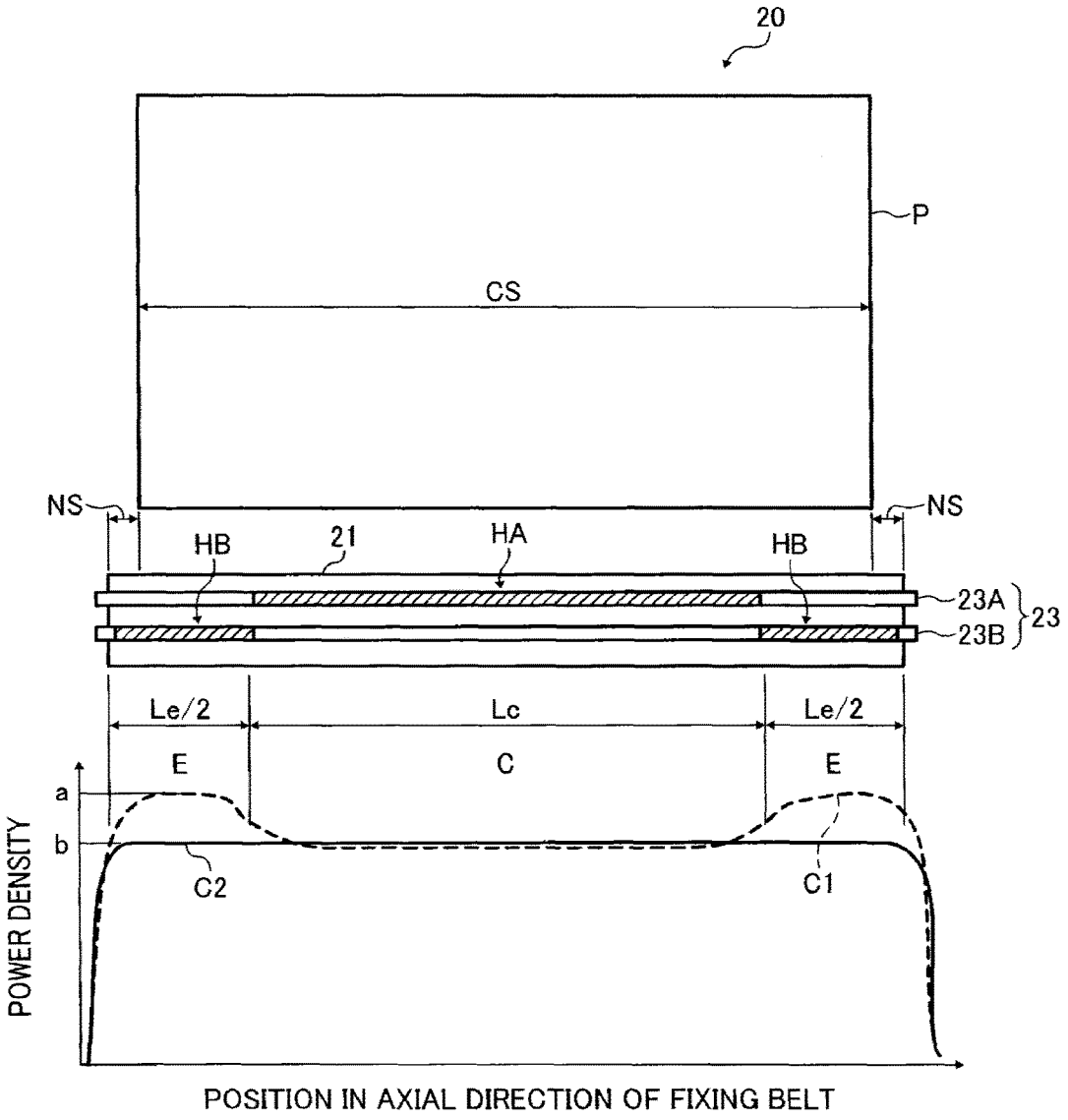
FIG. 9 is a diagram illustrating one example of the specification of a halogen heater pair incorporated in the fixing device shown in FIG. 5.

FIG. 9 is a diagram illustrating one example of the specification of the halogen heater pair 23. With reference to FIG. 9, the following describes a concept of power distribution of the halogen heater pair 23 according to this exemplary embodiment. As shown in FIG. 9, the halogen heater pair 23 is constructed of the halogen heater 23A having a center heat generator HA having a length Lc corresponding to a center C of the fixing belt 21 in the axial direction thereof and the halogen heater 23B having a lateral end heat generator HB having a length Le/2 corresponding to each lateral end E of the fixing belt 21 in the axial direction thereof.

In order to shorten the warm-up time, power supply to the halogen heater pair 23 is optimized for warm-up and an initial period of a print job for printing on a plurality of sheets P continuously. When the halogen heater pair 23 is controlled to output fully, the halogen heater pair 23 has a power density distribution shown by a broken curve C1 in FIG. 9.

During warm-up and the initial period of the print job when the entire fixing belt 21 is not heated sufficiently, heat is drawn or absorbed from each lateral end E of the fixing belt 21 in the axial direction thereof to the guide that guides the fixing belt 21 such as the flange 40. Thus, each lateral end E of the fixing belt 21 in the axial direction thereof may suffer from substantial temperature decrease when the print job starts. Such phenomenon may occur with the fixing belt 21 having a decreased loop diameter and a decreased thickness to save energy and shorten the warm-up time like in this exemplary embodiment.

To address this circumstance, according to the first example of control of the halogen heater pair 23, during warm-up and the initial period of the print job, power is supplied to each lateral end E of the fixing belt 21 in the axial direction thereof more than to the center C of the fixing belt 21 in the axial direction thereof. For example, during warm-up and the initial period of the print job when the fixing belt 21 is heated from an ambient temperature and therefore is heated insufficiently, power is supplied to each lateral end E of the fixing belt 21 in the axial direction thereof such that each lateral end E of the fixing belt 21 has an increased power density a defined by the broken curve C1. Hence, the control of the halogen heater pair 23 suppresses substantial temperature decrease of each lateral end E of the fixing belt 21 in the axial direction thereof while shortening the warm-up time and stabilizing rotation of the fixing belt 21, thus suppressing fixing failure caused by temperature decrease of each lateral end E of the fixing belt 21 in the axial direction thereof during the initial period of the print job.

For example, the initial period of the print job defines a period for printing on the first to twentieth sheets P of a print job for printing on about 100 sheets P of A4 size continuously. Alternatively, the initial period of the print job may define a period for printing on the initial several sheets P of a print job for printing on a decreased number of sheets P.

Conversely, during the latter half of the print job, in a non-conveyance span NS of the fixing belt 21 in the axial direction thereof where the sheets P are not conveyed, that is outboard from a conveyance span CS of the fixing belt 21 in the axial direction thereof where the sheets P are conveyed, the sheets P do not contact the fixing belt 21 and therefore do not draw heat from the fixing belt 21. Accordingly, when the sheets P are conveyed over the fixing belt 21 continuously, heat is accumulated on the non-conveyance span NS of the fixing belt 21. Consequently, during the latter half of the print job, the non-conveyance span NS of the fixing belt 21 may suffer from overheating, causing thermal degradation of the fixing belt 21.

Hence, an increased amount of power required to each lateral end E of the fixing belt 21 in the axial direction thereof during warm-up and the initial period of the print job is not necessary for the latter half of the print job. Thus, a power density distribution applicable to the halogen heater pair 23 during the latter half of the print job is indicated by a solid curve C2 in FIG. 9. For example, during the latter half of the print job or a next print job that starts immediately after the previous print job when the fixing belt 21 is heated sufficiently, power is supplied to each lateral end E of the fixing belt 21 in the axial direction thereof such that each lateral end E of the fixing belt 21 has a decreased power density b defined by the solid curve C2 that is lower than the increased power density a.

As shown in FIG. 9, the power density distribution of the halogen heater pair 23 suitable during warm-up and the initial period of the print job is different from that during the latter half of the print job.

In order to reduce power consumption of the entire image forming apparatus 1 within a predetermined amount, power available to the halogen heater pair 23 of the fixing device 20 is restricted according to power consumption of devices incorporated in the image forming apparatus 1 other than the fixing device 20. Additionally, as shown in a table 1 below, for example, power available to the halogen heater pair 23 of the fixing device 20 is different between during warm-up and during printing.

TABLE 1

| | |
|---|---|
| During warm-up | 1,250 W |
| During printing | 1,000 W |

Unless power to be supplied to the halogen heater pair 23 is distributed properly in the axial direction of the fixing belt 21, before power sufficient enough to heat the center C and each lateral end E of the fixing belt 21 in the axial direction thereof to the target temperature is supplied to the halogen heater pair 23, power consumption may have reached an upper limit of power available.

To address this circumstance, according to this exemplary embodiment, in a fixed output setting (e.g., a power density ratio) between the halogen heaters 23A and 23B, output of the halogen heater 23B during the latter half of the print job is reduced compared to that during the initial period of the print job. A reduced amount of power is added to the halogen heater 23A, thus determining output of the halogen heater 23A. Power supplied to the halogen heaters 23A and 23B and a power density ratio between a power density of the halogen heater 23A and a power density of the halogen heater 23B (hereinafter referred to as the power density ratio between the halogen heaters 23A and 23B or the power density ratio) are shown in tables 2 and 3 below.

The power density ratio between the halogen heaters 23A and 23B is defined by a formula (2) below.

$$Dr=Dc/De \quad (2)$$

In the formula (2), Dr represents the power density ratio. Dc represents a power density at the center C of the fixing belt 21 in the axial direction thereof. De represents a power density at each lateral end E of the fixing belt 21 in the axial direction thereof.

TABLE 2

| | Heat generation position (span) | | |
|---|---|---|---|
| | Center | Lateral end | Entire span |
| Halogen heater | Halogen heater 23A | Halogen heater 23B | Halogen heaters 23A and 23B |
| Fixed power | 650 W | 370 W | 1,020 W |
| Length | 220 mm | 110 mm | |
| Power density | 3.0 W/mm | 3.4 W/mm | |
| Power density ratio (Center/Lateral end) | 0.9 | | |

TABLE 3

| | Heat generation position (span) | | |
|---|---|---|---|
| | Center | Lateral end | Entire span |
| Halogen heater | Halogen heater 23A | Halogen heater 23B | Halogen heaters 23A and 23B |
| Fixed power | 700 W | 320 W | 1,020 W |
| Length | 220 mm | 110 mm | |
| Power density | 3.2 W/mm | 2.9 W/mm | |
| Power density ratio (Center/Lateral end) | 1.1 | | |

Figure 10:
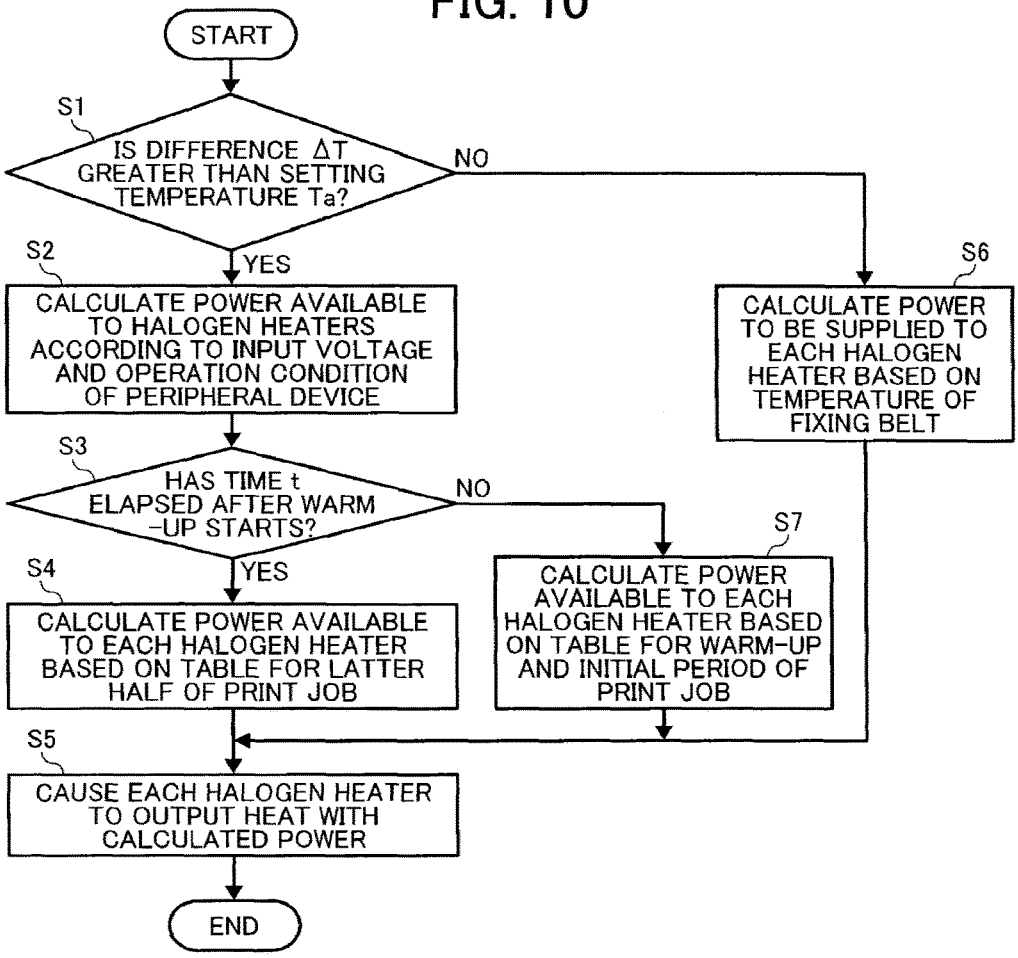
FIG. 10 is a flowchart showing control processes for controlling the halogen heater pair shown in FIG. 9.

FIG. 10 is a flowchart showing control processes for controlling the halogen heater pair 23.

In step S1, the controller 50 starts calculating a value for controlling the halogen heater pair 23 and determines whether or not a difference ΔT between the target fixing temperature and the temperature of the fixing belt 21 detected by the temperature sensor 27 is greater than a setting temperature Ta. The setting temperature Ta, that is, a reference to switch output of the halogen heaters 23A and 23B to the fixed power, is 1 degree centigrade, 3 degrees centigrade, 10 degrees centigrade, or the like in a range of from about 1 degree centigrade to about 20 degrees centigrade.

Since the fixing belt 21 has a decreased thermal capacity, even if the temperature of the fixing belt 21 is adjusted to the target fixing temperature, in the conveyance span CS where the sheets P are conveyed over the fixing belt 21, the sheets P, as they contact the fixing belt 21, draw heat from the fixing belt 21. Accordingly, the conveyance span CS of the fixing belt 21 may suffer from substantial temperature decrease.

Under a temperature control in which power supplied to the halogen heater pair 23 is changed based on the temperature of the fixing belt 21 detected by the temperature sensor 27, during printing on a plurality of sheets P continuously with increased productivity, once the temperature of the conveyance span CS of the fixing belt 21 decreases substantially, the halogen heater pair 23 may not heat the fixing belt 21 to the target fixing temperature constantly.

To address this circumstance, according to this exemplary embodiment, if the temperature of the fixing belt 21 detected by the temperature sensor 27 is lower than a preset temperature by a predetermined value or more, the controller 50 controls the halogen heater pair 23 to heat the fixing belt 21 with fixed output capable of heating the fixing belt 21 to the target fixing temperature regardless of the temperature of the fixing belt 21 detected by the temperature sensor 27. Accordingly, even during printing on the plurality of sheets P continuously with increased productivity, the temperature of the conveyance span CS of the fixing belt 21 is maintained at the target fixing temperature, suppressing temperature decrease of the conveyance span CS of the fixing belt 21 and resultant fixing failure.

If the difference ΔT is not greater than the setting temperature Ta (NO in step S1), the controller 50 calculates power to be required by the halogen heaters 23A and 23B based on the temperature of the fixing belt 21 detected by the temperature sensor 27 in step S6. In step S5, each of the halogen heaters 23A and 23B outputs heat with the calculated power, completing a series of control processes.

Conversely, if the difference ΔT is greater than the setting temperature Ta (YES in step S1), the controller 50 calculates power available to the halogen heater pair 23 according to input voltage and an operation condition of a peripheral device of the fixing device 20 in step S2. Thereafter, the controller 50 determines whether or not a time t has elapsed after warm-up starts, that is, after the halogen heater pair 23 starts heating the fixing belt 21, with the timer 51 incorporated in the controller 50 in step S3.

The time t is 5 seconds, 10 seconds, 15 seconds, or the like in a range of from about 5 seconds to about 30 seconds.

If the time t elapses after warm-up starts (YES in step S3), the controller 50 determines that the latter half of the print job starts and calculates power available to each of the halogen heaters 23A and 23B based on a table for the latter half of the print job in step S4. In step S5, each of the halogen heaters 23A and 23B outputs heat with the calculated power, completing a series of control processes.

Conversely, if the time t has not elapsed after warm-up starts (NO in step S3), the controller 50 determines that warm-up or the initial period of the print job continues and calculates power available to each of the halogen heaters 23A and 23B based on a table for warm-up and the initial period of the print job in step S7. In step S5, each of the halogen heaters 23A and 23B outputs heat with the calculated power, completing a series of control processes.

If the controller 50 controls the halogen heaters 23A and 23B based on the temperature of the fixing belt 21 detected by the temperature sensor 27 only, a particular span on the fixing belt 21 in the axial direction thereof may be heated to the target temperature but another span on the fixing belt 21 in the axial direction thereof may not be heated to the target temperature.

For example, during warm-up or the initial period of the print job, the flange 40 may draw heat from each lateral end E of the fixing belt 21 in the axial direction thereof, decreasing the temperature of each lateral end E of the fixing belt 21 in the axial direction thereof substantially during the initial period of the print job.

To address this circumstance, in the fixing device 20 according to this exemplary embodiment, the controller 50 determines fixed output by considering not only the temperature of the fixing belt 21 detected by the temperature sensor 27 but also the time t that elapses after warm-up starts, thus controlling the halogen heater pair 23 to heat the fixing belt 21. Accordingly, the halogen heater pair 23 heats the fixing belt 21 with a power distribution optimized for each of warm-up, the initial period of the print job, and the latter half of the print job, suppressing fixing failure caused by temperature decrease of the fixing belt 21 and forming the high quality toner image T on the sheet P.

When power available to the halogen heater pair 23 of the fixing device 20 is 1,020 W, 950 W, or 1,160 W under input voltage and the operation condition of the peripheral device, an upper limit of power and the power density ratio between the halogen heaters 23A and 23B are shown in the table 3 above and tables 4 and 5 below.

TABLE 4

| | Heat generation position (span) | | |
|---|---|---|---|
| | Center | Lateral end | Entire span |
| Halogen heater | Halogen heater 23A | Halogen heater 23B | Halogen heaters 23A and 23B |
| Fixed power | 670 W | 280 W | 950 W |
| Length | 220 mm | 110 mm | |
| Power density | 3.0 W/mm | 2.5 W/mm | |
| Power density ratio (Center/Lateral end) | 1.2 | | |

TABLE 5

| | Heat generation position (span) | | |
|---|---|---|---|
| | Center | Lateral end | Entire span |
| Halogen heater | Halogen heater 23A | Halogen heater 23B | Halogen heaters 23A and 23B |
| Fixed power | 750 W | 410 W | 1,160 W |
| Length | 220 mm | 110 mm | |
| Power density | 3.4 W/mm | 3.7 W/mm | |
| Power density ratio (Center/Lateral end) | 0.9 | | |

A detailed description is now given of a second example of control of the halogen heater pair 23.

As shown in FIG. 9, the power density distribution during warm-up is similar to that during the initial period of the print job. Conversely, power available to the halogen heater pair 23 of the fixing device 20 during warm-up is different from that during the print job.

Accordingly, the second example of control of the halogen heater pair 23 uses the fixed power shown in a table 6 below during warm-up and the fixed power shown in the table 2 above during the initial period of the print job. However, unlike the first example of control of the halogen heater pair 23, the power density ratio during warm-up is equivalent to that during the initial period of the print job.

TABLE 6

| | Heat generation position (span) | | |
|---|---|---|---|
| | Center | Lateral end | Entire span |
| Halogen heater | Halogen heater 23A | Halogen heater 23B | Halogen heaters 23A and 23B |
| Fixed power | 790 W | 430 W | 1,220 W |
| Length | 220 mm | 110 mm | |
| Power density | 3.6 W/mm | 3.9 W/mm | |
| Power density ratio (Center/Lateral end) | 0.9 | | |

Hence, the number of the tables to be referred to and the size of software used to actuate the fixing device 20 are decreased, resulting in reduced manufacturing costs.

A detailed description is now given of a third example of control of the halogen heater pair 23.

A table 7 below shows the fixed power and the power density ratio when the maximum output of the halogen heater 23A is 800 W, the maximum output of the halogen heater 23B is 400 W, and power available to the halogen heater pair 23 of the fixing device 20 is 1, 200 W.

TABLE 7

| | Heat generation position (span) | | |
|---|---|---|---|
| | Center | Lateral end | Entire span |
| Halogen heater | Halogen heater 23A | Halogen heater 23B | Halogen heaters 23A and 23B |
| Fixed power | 800 W | 400 W | 1,200 W |
| Length | 220 mm | 110 mm | |
| Power density | 3.6 W/mm | 3.6 W/mm | |
| Power density ratio (Center/Lateral end) | 1.0 | | |

A table 8 below shows the fixed power and the power density ratio when the maximum output of the halogen heater 23A is 800 W, the maximum output of the halogen heater 23B is 500 W, and power available to the halogen heater pair 23 of the fixing device 20 is 1, 300 W.

TABLE 8

| | Heat generation position (span) | | |
|---|---|---|---|
| | Center | Lateral end | Entire span |
| Halogen heater | Halogen heater 23A | Halogen heater 23B | Halogen heaters 23A and 23B |
| Fixed power | 800 W | 500 W | 1,300 W |
| Length | 220 mm | 110 mm | |
| Power density | 3.6 W/mm | 4.5 W/mm | |
| Power density ratio (Center/Lateral end) | 0.8 | | |

A table 9 below shows a setting range of the power density ratio during warm-up, the initial period of the print job, and the latter half of the print job.

TABLE 9

| | Center/Lateral end |
|---|---|
| During warm-up | 0.8 to 1.0 |
| During initial period of print job | 0.8 to 1.0 |
| During latter half of print job | 0.9 to 1.2 |

The table 7 above shows the power density ratio of 1.0. Contrarily, the table 8 above under power available to the halogen heater pair 23 of 1,300 W shows the power density ratio of 0.8. It is because, since power of the halogen heater 23A reaches the maximum output of 800 W, it is impossible to increase power of the halogen heater 23A under the power density ratio of 1.0. In a case in which it is impossible to increase power of one of the halogen heaters 23A and 23B, the power density ratio outside the setting range shown in the table 9 is applied to use power as much as possible.

A detailed description is now given of a fourth example of control of the halogen heater pair 23.

Figure 11:
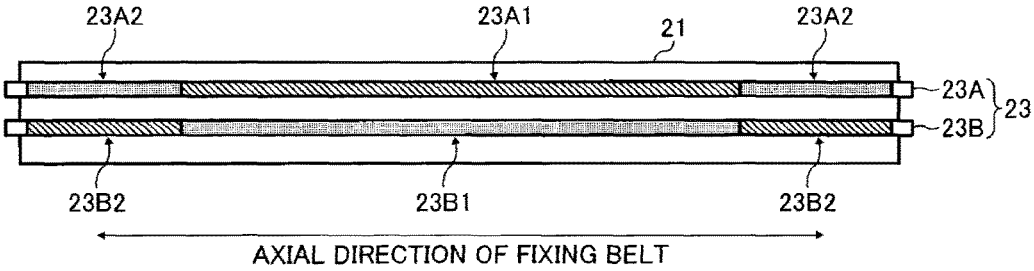
FIG. 11 is a diagram illustrating another example of the specification of the halogen heater pair incorporated in the fixing device shown in FIG. 5.

FIG. 11 is a diagram illustrating another example of the specification of the halogen heater pair 23 incorporated in the fixing device 20.

The above describes a configuration in which the halogen heater 23A heats the center C of the fixing belt 21 in the axial direction thereof and the halogen heater 23B heats each lateral end E of the fixing belt 21 in the axial direction thereof. Alternatively, other configurations are available. For example, each of the halogen heaters 23A and 23B may heat the entire span of the fixing belt 21 in the axial direction thereof.

As shown in FIG. 11, the halogen heater 23A serving as a first heater includes a center heat generator 23A1 serving as a first center heat generator and a plurality of lateral end heat generators 23A2 serving as first lateral end heat generators. Similarly, the halogen heater 23B serving as a second heater includes a center heat generator 23B 1 serving as a second center heat generator and a plurality of lateral end heat generators 23B2 serving as second lateral end heat generators. Thus, the halogen heaters 23A and 23B selectively heat the fixing belt 21 at the center C and each lateral end E in the axial direction thereof. A table below shows the upper limit of power and the power density ratio between the halogen heaters 23A and 23B.

TABLE 10

| | Heat generation position (span) | | | | |
|---|---|---|---|---|---|
| | Center | | Lateral end | | Entire span |
| Halogen heater | Halogen heater 23A | Halogen heater 23B | Halogen heater 23A | Halogen heater 23B | Halogen heaters 23A and 23B |
| Fixed power | 600 W | 120 W | 140 W | 200 W | 1,060 W |
| Length | 220 mm | 220 mm | 110 mm | 110 mm | |
| Power density | 2.7 W/mm | 0.5 W/mm | 1.3 W/mm | 1.8 W/mm | |
| Power density ratio (Center/Lateral end) | 1.1 | | | | |

When the halogen heaters 23A and 23B are controlled to achieve the maximum output, the power distribution is optimized, enhancing productivity.

A description is provided of a configuration of the image forming apparatus 1 according to a second exemplary embodiment.

A basic construction and an operation of the image forming apparatus 1 according to the second exemplary embodiment are equivalent to those of the image forming apparatus 1 according to the first exemplary embodiment described above and therefore a description thereof is omitted. The image forming apparatus 1 according to the second exemplary embodiment includes a fixing device 20T incorporating a temperature sensor 28 that detects the temperature of the pressure roller 22 in addition to the temperature sensor 27 that detects the temperature of the fixing belt 21.

A detailed description is now given of a fifth example of control of the halogen heater pair 23.

Figure 12:
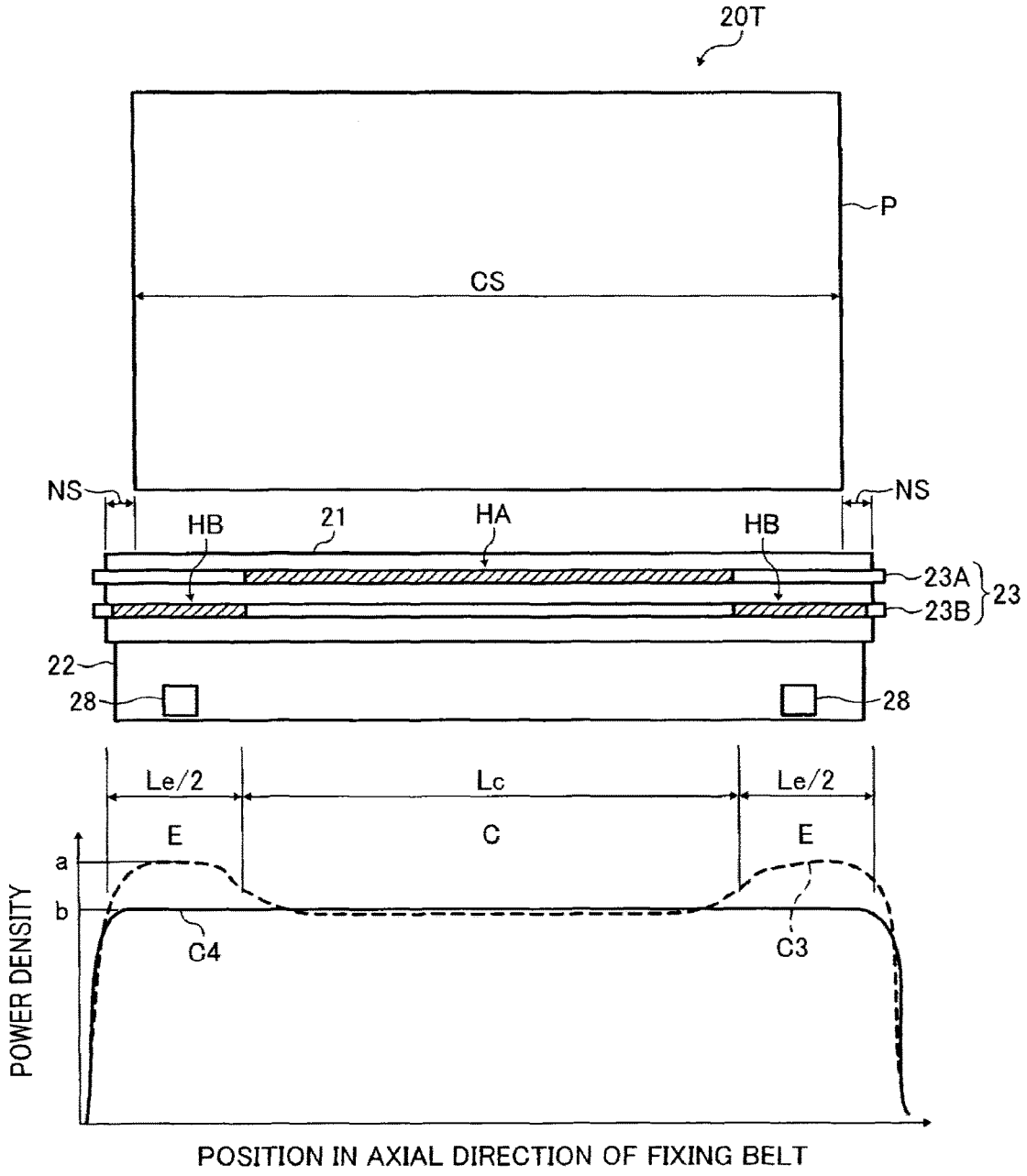
FIG. 12 is a diagram illustrating yet another example of the specification of the halogen heater pair incorporated in a fixing device installable in the image forming apparatus shown in FIG. 1.

FIG. 12 is a diagram illustrating one example of the specification of the halogen heater pair 23 incorporated in the fixing device 20T installed in the image forming apparatus 1 according to the second exemplary embodiment.

With reference to FIG. 12, the following describes a concept of power distribution of the halogen heater pair 23 according to the fifth example of control of the halogen heater pair 23.

In order to shorten the warm-up time, power supply to the halogen heater pair 23 is optimized for warm-up and an initial period of a print job for printing on a plurality of sheets P continuously. When the halogen heater pair 23 is controlled to output fully, the halogen heater pair 23 has a power density distribution shown by a broken curve C3 in FIG. 12.

According to the fifth example of control of the halogen heater pair 23, during warm-up and the initial period of the print job when the fixing belt 21 is not heated sufficiently, power is supplied to each lateral end E of the fixing belt 21 in the axial direction thereof more than to the center C of the fixing belt 21 in the axial direction thereof. Hence, the control of the halogen heater pair 23 suppresses substantial temperature decrease of each lateral end E of the fixing belt 21 in the axial direction thereof while shortening the warm-up time and stabilizing rotation of the fixing belt 21, thus suppressing fixing failure caused by temperature decrease of each lateral end E of the fixing belt 21 in the axial direction thereof during the initial period of the print job.

Conversely, during the latter half of the print job when the fixing belt 21 is heated sufficiently, in the non-conveyance span NS of the fixing belt 21 where the sheets P are not conveyed, the sheets P do not contact the fixing belt 21 and therefore do not draw heat from the fixing belt 21 although heat is supplied from the halogen heater pair 23 to the fixing belt 21. Accordingly, when the sheets P are conveyed over the fixing belt 21 continuously, heat is accumulated on the non-conveyance span NS of the fixing belt 21. Consequently, during the latter half of the print job, the non-conveyance span NS of the fixing belt 21 may suffer from overheating, causing thermal degradation of the fixing belt 21.

Hence, an increased amount of power required to each lateral end E of the fixing belt 21 in the axial direction thereof during warm-up and the initial period of the print job is not necessary. Thus, a power density distribution applicable to the halogen heater pair 23 during the latter half of the print job is indicated by a solid curve C4 in FIG. 12.

To address this circumstance, according to the fifth example of control of the halogen heater pair 23, in the fixed output setting (e.g., the power density ratio) between the halogen heaters 23A and 23B, output of the halogen heater 23B during the latter half of the print job when the fixing belt 21 is heated sufficiently is reduced compared to that during warm-up and the initial period of the print job when the fixing belt 21 is not heated sufficiently. A reduced amount of power is added to the halogen heater 23A, thus determining output of the halogen heater 23A.

Power supplied to the halogen heaters 23A and 23B and the power density ratio between the halogen heaters 23A and 23B are shown in the tables 2 and 3 above.

As power is supplied to the halogen heaters 23A and 23B according to the power density ratio between preset positions (e.g., preset spans) in the axial direction of the fixing belt 21, if power available to the halogen heater pair 23 is redundant, redundant power may be supplied to the halogen heater 23B. Accordingly, the halogen heater pair 23 enhances productivity.

Figure 13:
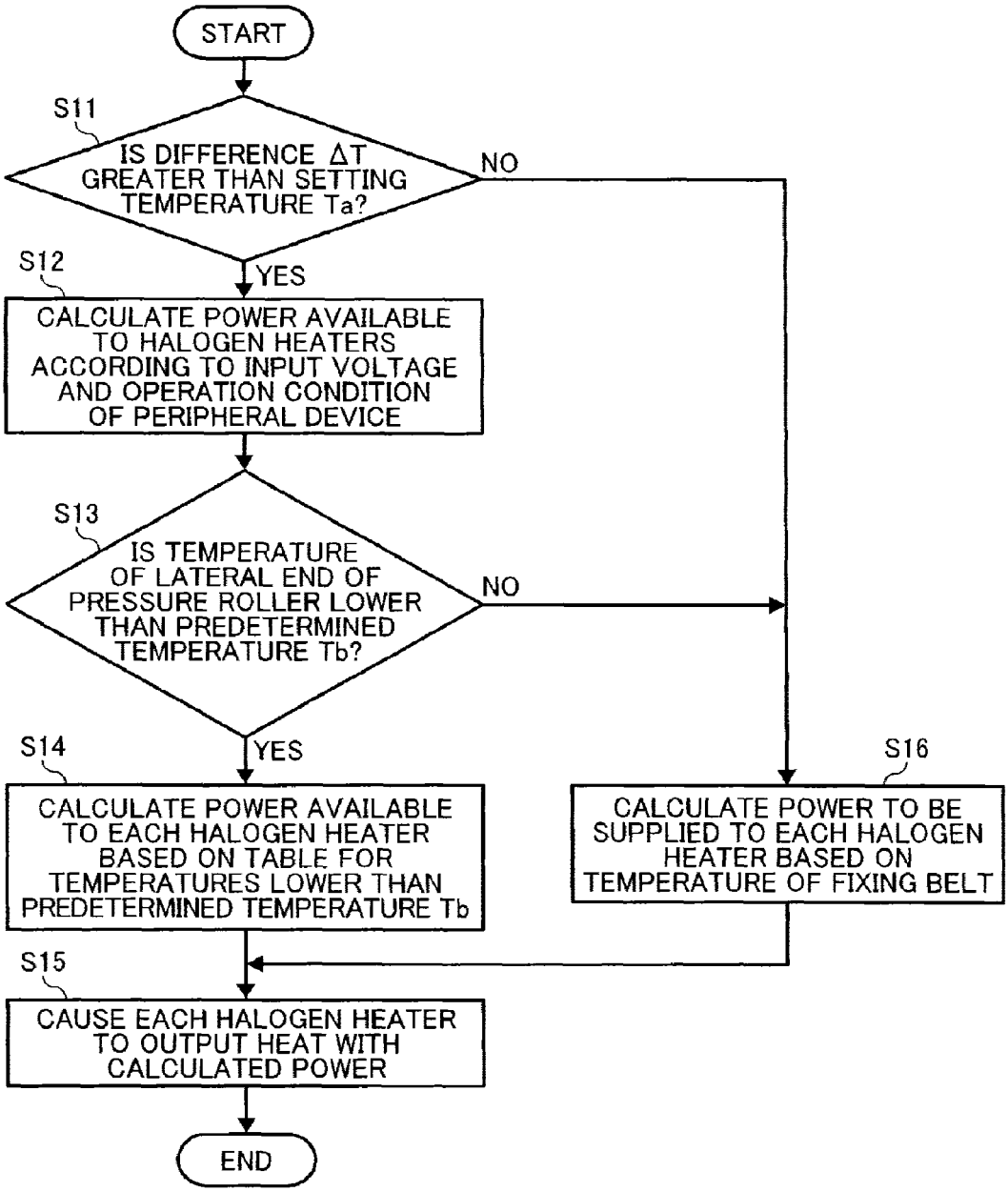
FIG. 13 is a flowchart showing control processes for controlling the halogen heater pair shown in FIG. 12.

FIG. 13 is a flowchart showing control processes for controlling the halogen heater pair 23.

In step S11, the controller 50 starts calculating a value for controlling the halogen heater pair 23 and determines whether or not the difference ΔT between the target fixing temperature and the temperature of the fixing belt 21 detected by the temperature sensor 27 is greater than the setting temperature Ta. The setting temperature Ta, that is, a reference to switch output of the halogen heaters 23A and 23B to the fixed output, is 1 degree centigrade, 3 degrees centigrade, 10 degrees centigrade, or the like in a range of from about 1 degree centigrade to about 20 degrees centigrade.

If the difference ΔT is not greater than the setting temperature Ta (NO in step S11), the controller 50 calculates power to be required by the halogen heaters 23A and 23B based on the temperature of the fixing belt 21 detected by the temperature sensor 27 in step S16. In step S15, each of the halogen heaters 23A and 23B outputs heat with the calculated power, completing a series of control processes.

Conversely, if the difference ΔT is greater than the setting temperature Ta (YES in step S11), the controller 50 calculates power available to the halogen heater pair 23 according to input voltage and an operation condition of a peripheral device of the fixing device 20T in step S12. In step S13, the controller 50 determines whether or not the temperature of each lateral end of the pressure roller 22 in the axial direction thereof detected by the temperature sensor 28 is lower than a predetermined temperature Tb.

For example, the predetermined temperature Tb is 30 degrees centigrade, 50 degrees centigrade, 70 degrees centigrade, or the like in a range of from about 30 degrees centigrade to about 100 degrees centigrade. Alternatively, a temperature sensor may detect the temperature of the lateral end E of the fixing belt 21 in the axial direction thereof that is heated by the lateral end heat generator HB of the halogen heater 23B and the controller 50 may determine whether or not the detected temperature is lower than a predetermined temperature.

If the temperature of the lateral end of the pressure roller 22 in the axial direction is lower than the predetermined temperature Tb (YES in step S13), the controller 50 determines that the fixing belt 21 is not heated sufficiently and calculates power available to each of the halogen heaters 23A and 23B based on a table for temperatures lower than the predetermined temperature Tb in step S14. In step S15, each of the halogen heaters 23A and 23B outputs heat with the calculated power, completing a series of control processes.

Conversely, if the temperature of the lateral end of the pressure roller 22 in the axial direction is not lower than the predetermined temperature Tb (NO in step S13), the controller 50 determines that the fixing belt 21 is heated sufficiently and calculates power required to each of the halogen heaters 23A and 23B based on the temperature of the fixing belt 21 detected by the temperature sensor 27 in step S16. In step S15, each of the halogen heaters 23A and 23B outputs heat with the calculated power, completing a series of control processes.

Thus, the halogen heater pair 23 heats the fixing belt 21 with the power distribution optimized according to a heating condition of the fixing belt 21, that is, whether or not the fixing belt 21 is heated sufficiently.

A detailed description is now given of a sixth example of control of the halogen heater pair 23.

Figure 14:
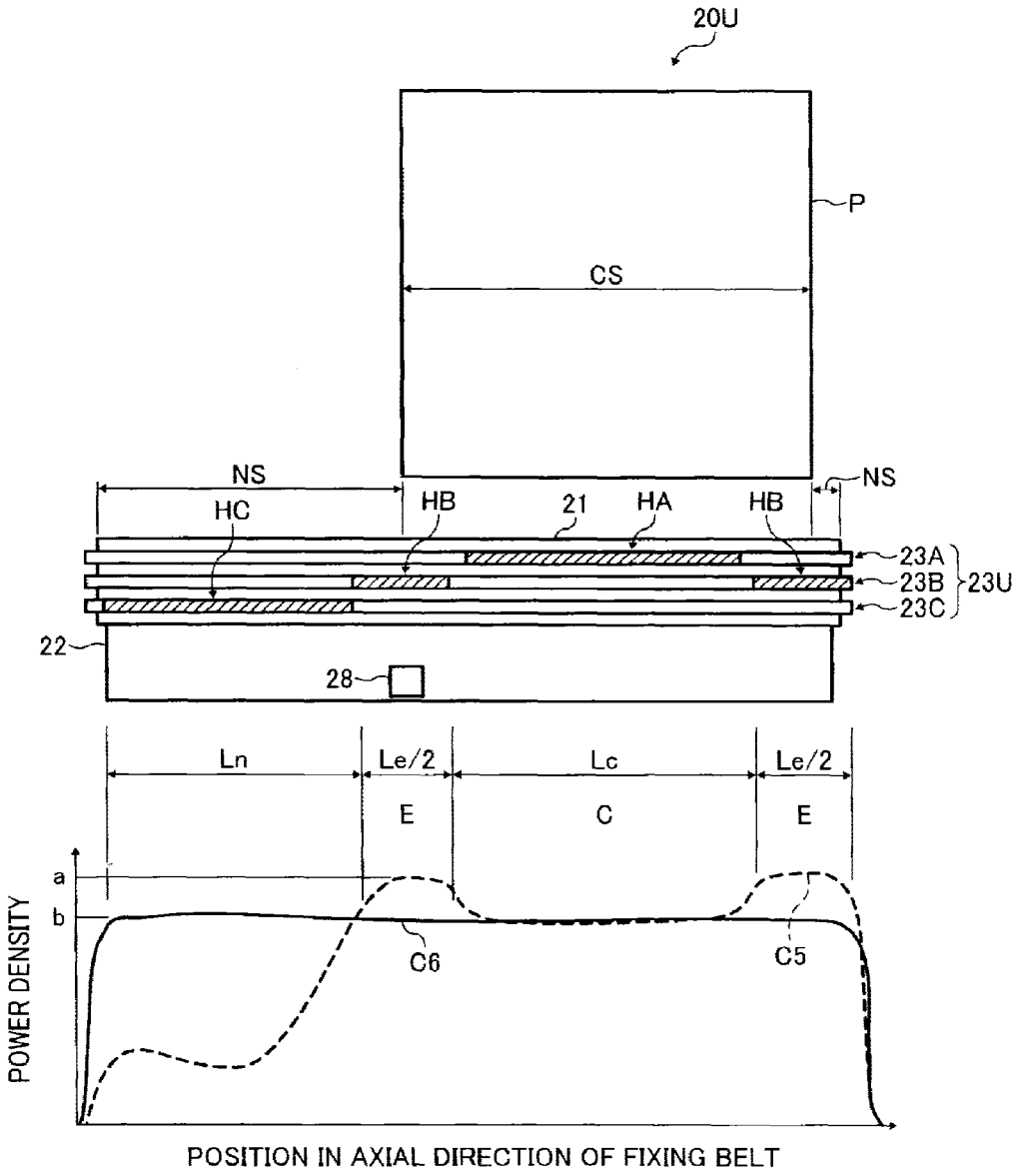
FIG. 14 is a diagram of a fixing device incorporating a halogen heater trio installable in the image forming apparatus shown in FIG. 1.

FIG. 14 is a diagram of a fixing device 20U incorporating a halogen heater trio 23U, that is installable in the image forming apparatus 1 depicted in FIG. 1.

With reference to FIG. 14, the following describes a case in which the center C of the fixing belt 21 in the axial direction thereof is supplied with a decreased amount of heat from the halogen heater trio 23U.

In the fixing device 20U, a sheet P is aligned along an alignment reference, that is, one lateral edge of the fixing belt 21 in the axial direction thereof while the sheet P is conveyed through the fixing nip N.

The halogen heater trio 23U of the fixing device 20U is constructed of three halogen heaters 23A, 23B, and 23C.

The halogen heater 23A has a center heat generator HA having a length Lc disposed opposite and heating the center C of the fixing belt 21 in the axial direction thereof corresponding to a center of the sheet P in a width direction thereof parallel to the axial direction of the fixing belt 21 that is conveyed over the fixing belt 21 along one lateral edge of the fixing belt 21 in the axial direction thereof. The halogen heater 23B has a lateral end heat generator HB having a length Le/2 disposed opposite and heating each side span of the fixing belt 21 in the axial direction thereof corresponding to each lateral end of the sheet P in the width direction thereof and a part of the non-conveyance span NS of the fixing belt 21 where the sheet P is not conveyed that abuts each lateral end of the sheet P in the width direction thereof. The halogen heater 23C has an outboard heat generator HC having a length Ln disposed opposite and heating the non-conveyance span NS of the fixing belt 21. The outboard heat generator HC is disposed opposite one lateral end of the fixing belt 21 in the axial direction thereof opposite another lateral end of the fixing belt 21 where the alignment reference is situated.

The temperature sensor 28 detects the temperature of a portion of the pressure roller 22 disposed opposite the lateral end heat generator HB of the halogen heater 23B that abuts a portion of the pressure roller 22 disposed opposite the outboard heat generator HC of the halogen heater 23C.

When the temperature of the portion of the pressure roller 22 disposed opposite the lateral end heat generator HB of the halogen heater 23B is lower than the predetermined temperature Tb and therefore the fixing belt 21 is not heated sufficiently, the power density distribution required to each of the halogen heaters 23A, 23B, and 23C is indicated by a broken curve C5 in FIG. 14.

Conversely, when the temperature of the portion of the pressure roller 22 disposed opposite the lateral end heat generator HB of the halogen heater 23B is higher than the predetermined temperature Tb and therefore the fixing belt 21 is heated sufficiently, the power density distribution required to each of the halogen heaters 23A, 23B, and 23C is indicated by a solid curve C6 in FIG. 14.

According to the sixth example of control of the halogen heater trio 23U, in the fixed output setting (e.g., the power density ratio) between the halogen heaters 23A, 23B, and 23C, output of the halogen heater 23B when the fixing belt 21 is heated sufficiently is reduced compared to that when the fixing belt 21 is not heated sufficiently. A reduced amount of power is added to the halogen heater 23A, thus determining output of the halogen heater 23A.

Hence, the halogen heater trio 23U heats the fixing belt 21 with the power distribution optimized according to a heating condition of the fixing belt 21, that is, whether or not the fixing belt 21 is heated sufficiently.

A detailed description is now given of a seventh example of control of the halogen heater pair 23.

Figure 15:
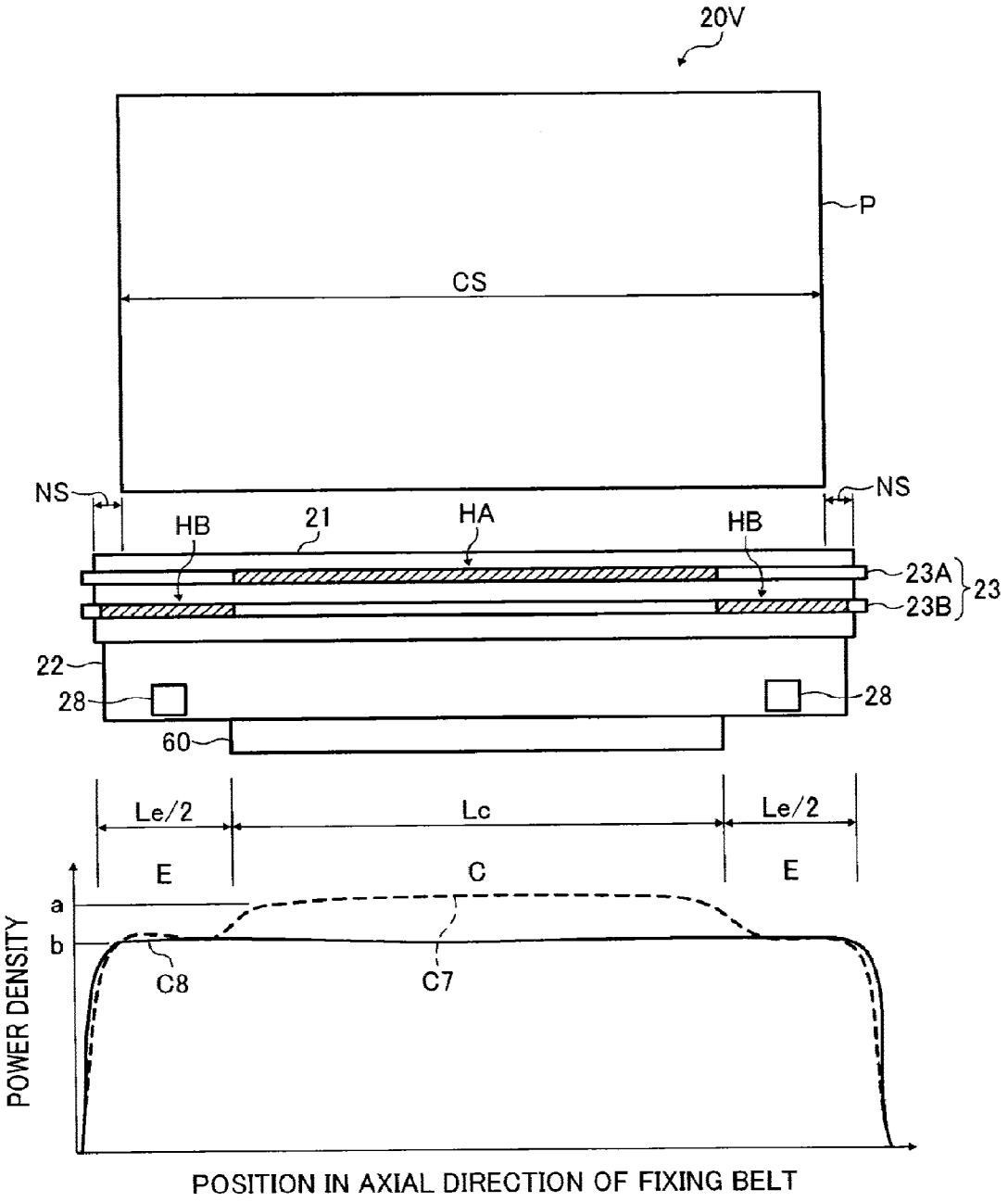
FIG. 15 is a diagram of a fixing device incorporating the halogen heater pair shown in FIG. 12 installable in the image forming apparatus shown in FIG. 1.

FIG. 15 is a diagram of a fixing device 20V incorporating the halogen heater pair 23, that is installable in the image forming apparatus 1 depicted in FIG. 1.

With reference to FIG. 15, the following describes a case in which the center C of the fixing belt 21 in the axial direction thereof is supplied with a decreased amount of heat from the halogen heater pair 23.

The halogen heater pair 23 of the fixing device 20V is constructed of two halogen heaters 23A and 23B having the center heat generator HA and the lateral end heat generators HB, respectively, that are identical to those shown in FIG. 12.

As shown in FIG. 15, the fixing device 20V includes a cleaner 60 contacting a center of the pressure roller 22 in the axial direction thereof to clean an outer circumferential surface of the pressure roller 22. The temperature sensor 28 is disposed opposite each lateral end of the pressure roller 22 in the axial direction thereof to detect the temperature of the pressure roller 22.

As shown in FIG. 15, while the cleaner 60 contacts the center of the pressure roller 22 in the axial direction thereof, the cleaner 60 absorbs heat from the center of the pressure roller 22 in the axial direction thereof.

The cleaner 60 draws heat moving from the center of the fixing belt 21 in the axial direction thereof to the center of the pressure roller 22 in the axial direction thereof. Accordingly, an increased amount of heat need to be supplied to the fixing belt 21 and a relatively decreased amount of heat is supplied to the pressure roller 22.

When the temperature of the portion of the pressure roller 22 disposed opposite the lateral end heat generator HB of the halogen heater 23B is lower than the predetermined temperature Tb and therefore the fixing belt 21 is not heated sufficiently, the power density distribution required to each of the halogen heaters 23A, 23B, and 23C is indicated by a broken curve C7 in FIG. 15.

Conversely, when the temperature of the portion of the pressure roller 22 disposed opposite the lateral end heat generator HB of the halogen heater 23B is higher than the predetermined temperature Tb and therefore the fixing belt 21 is heated sufficiently, the power density distribution required to each of the halogen heaters 23A, 23B, and 23C is indicated by a solid curve C8 in FIG. 15.

According to the seventh example of control of the halogen heater pair 23, when the fixing belt 21 is not heated sufficiently, the fixed output setting (e.g., the power density ratio) between the halogen heaters 23A and 23B is determined such that an amount of power allocated to the halogen heater 23A is greater than an amount of power allocated to the halogen heater 23B.

Conversely, when the fixing belt 21 is heated sufficiently, the fixed output setting (e.g., the power density ratio) between the halogen heaters 23A and 23B is determined such that a reduced amount of power is supplied to the halogen heater 23A. A reduced amount of power is added to the halogen heater 23B, thus determining output of the halogen heater 23B.

Hence, the halogen heater pair 23 heats the fixing belt 21 with the power distribution optimized according to a heating condition of the fixing belt 21, that is, whether or not the fixing belt 21 is heated sufficiently.

When power available to the halogen heater pair 23 of the fixing device 20V is 1,020 W, 950 W, or 1,160 W, an upper limit of power and the power density ratio thereof are shown in the tables 3 to 5 above according to input voltage and an operation condition of a peripheral device of the fixing device 20V.

A detailed description is now given of an eighth example of control of the halogen heater pair 23.

The power density distribution during warm-up is similar to that during the initial period of the print job. Conversely, power available to the halogen heater pair 23 of the fixing device 20V during warm-up is different from that during the print job.

Accordingly, the eighth example of control of the halogen heater pair 23 uses the fixed power shown in the table 6 above during warm-up and the fixed power shown in the table 2 above during the initial period of the print job. However, the power density ratio during warm-up is equivalent to that during the initial period of the print job.

Hence, the number of the tables to be referred to and the size of software used to actuate the fixing device 20V are decreased, resulting in reduced manufacturing costs.

A detailed description is now given of a ninth example of control of the halogen heater pair 23.

The table 7 above shows the fixed power and the power density ratio when the maximum output of the halogen heater 23A is 800 W, the maximum output of the halogen heater 23B is 400 W, and power available to the halogen heater pair 23 of the fixing device 20V is 1, 200 W.

The table 8 above shows the fixed power and the power density ratio when the maximum output of the halogen heater 23A is 800 W, the maximum output of the halogen heater 23B is 500 W, and power available to the halogen heater pair 23 of the fixing device 20V is 1, 300 W.

A table 11 below shows a setting range of the power density ratio when the temperature of the lateral end of the pressure roller 22 in the axial direction thereof is lower than and not lower than the predetermined temperature Tb.

TABLE 11

| | Power density ratio (Center/Lateral end) |
|---|---|
| Lower than predetermined temperature Tb | 0.8 to 1.0 |
| Not lower than predetermined temperature Tb | 0.9 to 1.2 |

The table 7 above shows the power density ratio of 1.0. Contrarily, the table 8 above under power available to the halogen heater pair 23 of 1, 300 W shows the power density ratio of 0.8. It is because, since power of the halogen heater 23A reaches the maximum output of 800 W, it is impossible to increase power of the halogen heater 23A under the power density ratio of 1.0.

In a case in which it is impossible to increase power of one of the halogen heaters 23A and 23B, the power density ratio outside the setting range shown in the table 11 is applied to use power as much as possible.

A detailed description is now given of a tenth example of control of the halogen heater pair 23.

The above describes a configuration in which the halogen heater 23A heats the center C of the fixing belt 21 in the axial direction thereof and the halogen heater 23B heats each lateral end E of the fixing belt 21 in the axial direction thereof. Alternatively, other configurations are available. For example, each of the halogen heaters 23A and 23B may heat the entire span of the fixing belt 21 in the axial direction thereof.

As shown in FIG. 11, the halogen heater 23A includes the center heat generator 23A1 and the plurality of lateral end heat generators 23A2. Similarly, the halogen heater 23B includes the center heat generator 23B 1 and the plurality of lateral end heat generators 23B2. Thus, the halogen heaters 23A and 23B selectively heat the fixing belt 21 at the center C and each lateral end E in the axial direction thereof.

The table 10 above shows the upper limit of power and the power density ratio between the halogen heaters 23A and 23B.

When the halogen heaters 23A and 23B are controlled to achieve the maximum output, the power distribution is optimized, enhancing productivity.

The above describes examples of control of the halogen heater pair 23 and the halogen heater trio 23U, which attain advantages below in a plurality of aspects A to J.

In the aspect A, an image forming apparatus (e.g., the image forming apparatus 1) installed with a fixing device (e.g., the fixing devices 20, 20S, 20T, 20U, and 20V) includes an endless fixing belt (e.g., the fixing belt 21) rotatable in a predetermined direction of rotation; a heater set (e.g., the halogen heater pair 23 and the halogen heater trio 23U) disposed opposite and heating the fixing belt; a power supply (e.g., the power supply 61) connected to the heater set to supply power to the heater set; a controller (e.g., the controller 50) operatively connected to the power supply to control the power supply; and a guide (e.g., the flange 40) separably contacting an inner circumferential surface of a lateral end of the fixing belt in an axial direction thereof to guide the fixing belt as it rotates. The heater set includes a first heater (e.g., the halogen heater 23A) disposed opposite and heating at least a center (e.g., the center C) of the fixing belt in the axial direction thereof and a second heater (e.g., the halogen heater 23B) disposed opposite and heating at least the lateral end (e.g., the lateral end E) of the fixing belt in the axial direction thereof. The controller includes a calculator (e.g., the timer 51) to calculate an elapsed time elapsed after at least one of the first heater and the second heater starts warming up or heating the fixing belt. When the elapsed time calculated by the calculator is smaller than a predetermined time, the controller controls the power supply to supply power to the first heater and the second heater such that a power density of the second heater is greater than a power density of the first heater.

Accordingly, as described above, the fixing device suppresses fixing failure caused by temperature decrease of the fixing belt while shortening the warm-up time and stabilizing rotation of the fixing belt.

In the aspect B, an image forming apparatus (e.g., the image forming apparatus 1) installed with a fixing device (e.g., the fixing devices 20T, 20U, and 20V) includes an endless fixing belt (e.g., the fixing belt 21) rotatable in a predetermined direction of rotation; an opposed member (e.g., the pressure roller 22) contacting an outer circumferential surface of the fixing belt to form a fixing nip therebetween through which a recording medium (e.g., a sheet P) bearing a toner image is conveyed; a heater set (e.g., the halogen heater pair 23 and the halogen heater trio 23U) disposed opposite and heating the fixing belt; a power supply (e.g., the power supply 61) connected to the heater set to supply power to the heater set; a controller (e.g., the controller 50) operatively connected to the power supply to control the power supply; an abutment (e.g., the flange 40) to contact the fixing belt in an absorption span (e.g., the lateral end E) of the fixing belt in an axial direction thereof where the abutment absorbs heat from the fixing belt; and a first temperature detector (e.g., the temperature sensor 28) disposed opposite the opposed member to detect a temperature of the opposed member. The heater set includes a first heater (e.g., the halogen heater 23A) disposed opposite and heating at least an inboard span (e.g., the center C) of the fixing belt inboard from the absorption span in the axial direction thereof and a second heater (e.g., the halogen heater 23B) disposed opposite and heating at least the absorption span of the fixing belt. When the temperature detected by the first temperature detector is smaller than a preset first temperature, the controller controls the power supply to supply power to the first heater and the second heater such that a power density of the second heater is greater than a power density of the first heater.

Accordingly, as described above, the fixing device suppresses fixing failure caused by temperature decrease of the fixing belt while shortening the warm-up time.

In the aspect C, in addition to the aspect B, the abutment includes a guide (e.g., the flange 40) separably contacting an inner circumferential surface of a lateral end of the fixing belt in the axial direction thereof to guide the fixing belt as it rotates. As shown in FIG. 14, the absorption span of the fixing belt where the abutment absorbs heat from the fixing belt is disposed opposite at least a lateral end of the recording medium in the axial direction of the fixing belt. The inboard span of the fixing belt is disposed opposite at least a center of the recording medium in the axial direction of the fixing belt. The first temperature detector is disposed opposite at least a portion of the opposed member that is disposed opposite the lateral end of the recording medium to detect a temperature of the opposed member. When the temperature detected by the first temperature detector is smaller than a preset first temperature, the controller controls the power supply to supply power to the first heater and the second heater such that the power density of the second heater is greater than the power density of the first heater.

Accordingly, as described above, the fixing device suppresses fixing failure caused by temperature decrease of the fixing belt while shortening the warm-up time and stabilizing rotation of the fixing belt.

In the aspect D, in addition to the aspect A, B, or C, the image forming apparatus further includes a second temperature detector (e.g., the temperature sensor 27) disposed opposite the fixing belt to detect a temperature of the fixing belt. The controller further includes a power detector (e.g., the power detector 52) to detect power available to the heater set. When the temperature detected by the second temperature detector is smaller than a preset second temperature (e.g., the setting temperature Ta) by at least a predetermined value, the controller controls the power supply to supply power to the first heater and the second heater to heat the fixing belt such that the first heater and the second heater output heat at preset fixed outputs, respectively, based on the power detected by the power detector.

Accordingly, as described above, the fixing device retains a target temperature of the fixing belt, suppressing fixing failure caused by temperature decrease of the fixing belt.

In the aspect E, in addition to the aspect D, when the power detected by the power detector is greater than a preset power, the controller controls the power supply to supply power to the first heater and the second heater such that the power density of the second heater is greater than the power density of the first heater.

Accordingly, as described above, the fixing device suppresses temperature decrease of the lateral end of the fixing belt in the axial direction thereof while shortening the warm-up time.

In the aspect F, in addition to the aspect A, B, C, D, or E, as shown in FIG. 11, each of the first heater and the second heater heats the entire span of the fixing belt in the axial direction thereof. For example, the first heater includes a first center heat generator (e.g., the center heat generator 23A1) disposed opposite the center of the fixing belt in the axial direction thereof and having an increased power density and a first lateral end heat generator (e.g., the lateral end heat generator 23A2) disposed opposite the lateral end of the fixing belt in the axial direction thereof and having a decreased power density. The second heater includes a second center heat generator (e.g., the center heat generator 23B1) disposed opposite the center of the fixing belt in the axial direction thereof and having a decreased power density and a second lateral end heat generator (e.g., the lateral end heat generator 23B2) disposed opposite the lateral end of the fixing belt in the axial direction thereof and having an increased power density. Thus, a combined power density combining the power density of the first heater and the power density of the second heater attains a power density ratio even between the center and the lateral end of the fixing belt in the axial direction thereof.

Accordingly, as described above, when the first heater and the second heater achieve the maximum output, power distribution is optimized, enhancing productivity.

In the aspect G, in addition to the aspect A, B, C, D, E, or F, a power density ratio between the power density of the first heater and the power density of the second heater is constant during warm-up and during an initial period of a print job for printing on a plurality of recording media continuously.

Accordingly, as described above, the number of the tables to be referred to and the size of software used to actuate the fixing device are decreased, resulting in reduced manufacturing costs.

In the aspect H, in addition to the aspect A, B, C, D, E, F, or G, when the power supply supplies power to the first heater and the second heater according to the power density ratio at preset positions or spans on the fixing belt in the axial direction thereof, if the controller determines that power available to the first heater and the second heater is redundant, the controller controls the power supply to supply redundant power to the second heater.

Accordingly, the first heater and the second heater output heat with enhanced productivity.

In the aspect I, in addition to the aspect A, B, C, D, E, F, G, or H, if the controller determines that power supplied by the power supply to the first heater or the second heater exceeds the maximum output of the first heater or the second heater, the controller controls the power supply to change the power density ratio between the power density of the first heater and the power density of the second heater to supply the maximum power available to the first heater and the second heater thereto.

Accordingly, as described above, the first heater and the second heater use the maximum power available thereto, improving quality of the toner image formed on the recording medium.

In the aspect J, as shown in FIG. 1, an image forming apparatus (e.g., the image forming apparatus 1) includes an image bearer (e.g., the photoconductor 5); an image forming device including the charger 6, the developing device 7, and the exposure device 9 to form a toner image on the image bearer; a transfer device (e.g., the transfer device 3) to transfer the toner image formed on the image bearer onto a recording medium (e.g., a sheet P); and a fixing device (e.g., the fixing devices 20, 20S, 20T, 20U, and 20V) to fix the toner image on the recording medium. The fixing device is one of the fixing devices in the aspects A to I.

Accordingly, as described above, the fixing device optimizes the power distribution of the heater set and suppresses fixing failure caused by temperature decrease of the fixing belt while shortening the warm-up time and stabilizing rotation of the fixing belt, thus forming the high quality toner image on the recording medium.

As described above, in the exemplary embodiments of this disclosure, the power density is defined by the formula (1) at the center and the lateral end of the fixing belt in the axial direction thereof. As the power density increases, the heater set heats the center and the lateral end of the fixing belt in the axial direction thereof with an increased amount of heat.

If the elapsed time after warm-up starts is shorter than the predetermined time, the power supply supplies power to the first heater and the second heater such that the power density of the second heater disposed opposite the lateral end of the fixing belt in the axial direction is greater than the power density of the first heater disposed opposite the center of the fixing belt in the axial direction thereof. Accordingly, during warm-up, the initial period of the print job, or the like when the interior of the fixing device is not heated sufficiently, the controller increases an amount of heat conducted from the second heater to the lateral end of the fixing belt in the axial direction thereof compared to an amount of heat conducted from the first heater to the center of the fixing belt in the axial direction thereof. Accordingly, even if the guide draws heat from the lateral end of the fixing belt in the axial direction thereof during the initial period of the print job, temperature decrease at the lateral end of the fixing belt in the axial direction thereof is reduced compared to a case in which the lateral end of the fixing belt in the axial direction thereof is heated with an amount of heat identical to an amount of heat with which the center of the fixing belt in the axial direction thereof is heated. Consequently, shortage of heat caused by substantial temperature decrease at the lateral end of the fixing belt in the axial direction thereof during the initial period of the print job is suppressed, thus preventing fixing failure.

That is, fixing failure caused by temperature decrease at the lateral end of the fixing belt in the axial direction thereof during the initial period of the print job is suppressed while shortening the warm-up time and stabilizing rotation of the fixing belt.

According to the exemplary embodiments described above, the fixing belt 21 serves as an endless fixing belt. Alternatively, a fixing film, a fixing sleeve, or the like may be used as an endless fixing belt. Further, the pressure roller 22 serves as an opposed member. Alternatively, a pressure belt, a pressure pad, or the like may be used as an opposed member.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. An image forming apparatus comprising:

an endless fixing belt rotatable in a predetermined direction of rotation;

an opposed member contacting an outer circumferential surface of the fixing belt to form a fixing nip therebetween through which a recording medium bearing a toner image is conveyed;

an abutment to contact the fixing belt in an absorption span of the fixing belt in an axial direction thereof where the abutment absorbs heat from the fixing belt;

a first heater disposed opposite and heating at least an inboard span of the fixing belt inboard from the absorption span in the axial direction thereof;

a second heater disposed opposite and heating at least the absorption span of the fixing belt;

a first temperature detector disposed opposite the opposed member to detect a temperature of the opposed member;

a power supply connected to the first heater and the second heater to supply power to the first heater and the second heater; and a controller operatively connected to the first temperature detector and the power supply to control the power supply, the controller to control the power supply to supply a non-zero power to the first heater and a non-zero power to the second heater such that a power density of the second heater is greater than a power density of the first heater when the temperature of the opposed member detected by the first temperature detector is smaller than a preset first temperature.

2. The image forming apparatus according to claim 1, wherein the first temperature detector is disposed opposite a lateral end of the opposed member in the axial direction of the fixing belt.

3. The image forming apparatus according to claim 1, wherein the abutment includes a guide separably contacting an inner circumferential surface of the fixing belt at a lateral end of the fixing belt in the axial direction thereof to guide the fixing belt as the fixing belt rotates, and wherein the absorption span of the fixing belt is disposed opposite at least a lateral end of the recording medium in the axial direction of the fixing belt and the inboard span of the fixing belt is disposed opposite at least a center of the recording medium in the axial direction of the fixing belt.

4. The image forming apparatus according to claim 3, further comprising a cleaner contacting an outer circumferential surface of the opposed member at a center of the opposed member in an axial direction thereof to clean the opposed member.

5. The image forming apparatus according to claim 1, further comprising a second temperature detector disposed opposite the fixing belt to detect a temperature of the fixing belt, wherein the controller is operatively connected to the second temperature detector and further includes a power detector to detect power available to the first heater and the second heater, and wherein, when the temperature of the fixing belt detected by the second temperature detector is smaller than a preset second temperature by at least a predetermined value, the controller controls the power supply to supply power to the first heater and the second heater such that the first heater and the second heater output heat at preset fixed outputs, respectively, based on the power detected by the power detector.

6. The image forming apparatus according to claim 5, wherein, when the power detected by the power detector is greater than a preset power, the controller controls the power supply to supply power to the first heater and the second heater such that the power density of the second heater is greater than the power density of the first heater.

7. The image forming apparatus according to claim 1, wherein the opposed member includes a pressure roller.

* * * * *